US007666103B2

(12) United States Patent
Pondorfer et al.

(10) Patent No.: US 7,666,103 B2
(45) Date of Patent: Feb. 23, 2010

(54) AMUSEMENT RIDE

(75) Inventors: Walter Pondorfer, Tirol (AT); Laurence Ross Petrie, Byford (AU)

(73) Assignee: Cottingham Agencies Ltd., Enfield Middlesex (GB)

( * ) Notice: Subject to any disclaimer, the term of this patent is extended or adjusted under 35 U.S.C. 154(b) by 0 days.

(21) Appl. No.: 11/023,063

(22) Filed: Dec. 27, 2004

(65) Prior Publication Data

US 2005/0239563 A1 Oct. 27, 2005

(30) Foreign Application Priority Data

Jan. 29, 2004 (AU) ..... PCT/AU2004/000099
Aug. 12, 2004 (AU) ..... 2004904550

(51) Int. Cl.
*A63G 1/28* (2006.01)
*A63G 1/00* (2006.01)

(52) U.S. Cl. ..... 472/33; 472/34; 472/50

(58) Field of Classification Search ..... 472/29, 472/32–34, 3, 130, 133
See application file for complete search history.

(56) References Cited

U.S. PATENT DOCUMENTS 817,402 A * 4/1906 Strickler ..... 472/33
1,473,980 A * 11/1923 Traver ..... 472/33
1,625,877 A * 4/1927 Wood ..... 472/33
1,712,340 A * 5/1929 Fankhauser et al. ..... 472/2
2,142,169 A * 1/1939 Bisch ..... 472/33
3,840,225 A * 10/1974 Fouche ..... 472/3
4,576,373 A 3/1986 Spieldiener et al.
5,046,719 A * 9/1991 Comstock et al. ..... 472/49
5,658,201 A 8/1997 Kleimeyer et al.
5,688,178 A * 11/1997 Emrie ..... 472/31

(Continued)

FOREIGN PATENT DOCUMENTS

DE 910630 5/1954

(Continued)

OTHER PUBLICATIONS

International Search Report of PCT/AU2004/000099, mailed May 7, 2004.

(Continued)

*Primary Examiner*—Kien T Nguyen
(74) *Attorney, Agent, or Firm*—Thompson Hine LLP; Anthony H. Handal

(57) ABSTRACT

An amusement ride (10) involving riders (17) being conveyed through the air. The amusement ride (10) comprises a tower (11) having a column (23), typically of a height of at least 30 meters. A hub structure (33) is supported on the column (23) for rotation with respect thereto and for displacement thereal-long. A first drive means (51) is provided for rotating the hub structure (33) with respect to the column (23). A second drive means (61) is provided for displacing the hub structure (33) along the column (23). Rider carriers (81) are suspended from the hub structure (33) to undergo motion in response to movement of the hub structure (33) with respect to the column (23), involving the riders (17) being conveyed along a path around the column (23), with the elevation of the riders changing during the ride through displacement of the hub structure (33) along the column (23). The amusement ride (10) is of a design which is conducive to construction on a large scale.

46 Claims, 28 Drawing Sheets

U.S. PATENT DOCUMENTS

| | | | | |
|---|---|---|---|---|
| 5,709,606 | A | 1/1998 | Ehrman | |
| 5,820,469 | A | 10/1998 | Nobbs | |
| 5,957,779 | A | 9/1999 | Larson | |
| 6,126,552 | A * | 10/2000 | Harrap | 472/130 |
| 6,497,623 | B2 | 12/2002 | Mirfin et al. | |
| 6,755,749 | B2 * | 6/2004 | Stengel | 472/50 |
| 2003/0017880 | A1 | 1/2003 | Kleimeyer | |

FOREIGN PATENT DOCUMENTS

| | | |
|---|---|---|
| DE | 29 06 369 | 8/1980 |
| DE | 3431639 A1 | 3/1986 |
| DE | 101 30 085 A1 | 1/2003 |
| NL | 7901308 | 8/1980 |

OTHER PUBLICATIONS

Ride-Index.de, http://www.ride-index.de/, Feb. 20, 2009.
Ride-Index.de, "Power Tower", http://www.ride-index.de/include.php?path=content&mode=print&contentid=1070, Feb. 5, 2009.
Ride-Index.de, "Action Tower", http://www.ride-index.de/include.php?path=content&mode=print&contentid=6, Feb. 5, 2009.
Ride-Index.de, "Shot'N'Drop", http://www.ride-index.de/include.php?path=content&mode=print&contentid=1166, Feb. 5, 2009.
Ride-Index.de, "Power Tower 2", http://www.ride-index.de/include.php?path=content/content.php&contentid=467, Feb. 5, 2009.
Ride-Index.de, "Top of the World", http://www.ride-index.de/include.php? path=content&mode=print&contentid=1239, Feb. 5, 2009.
Declaration of Mara Marchi, Feb. 13, 2009.
Acceptance test Z-Force Ankara, May 2000.
Trailer manufacturing certificate.
Declaration of Alberto Zamperla, Feb. 19, 2009.
Technical Specifications, www.zamperla.it.
Eiffel Tower dimensions, http://upload.wikimedia.org/wikipedia/commons/thumb/e/ec/Dimes...., Feb. 23, 2009.
Figure of Branca tower, http://ciaomilano.it/img.big/tbranca.gif, Feb. 23, 2009.

* cited by examiner

AMUSEMENT RIDE

FIELD OF THE INVENTION

This invention relates to an amusement ride, and more particularly to an aerial amusement ride involving one or more riders being conveyed through the air. The invention also relates to a method of conducting an amusement ride.

BACKGROUND ART

There are a variety of amusement rides involving a rider or riders being conveyed through the air in a manner somewhat simulating flight. The rides can be on a relatively small scale for use in playgrounds, or on a much larger scale for use in fair grounds and theme parks.

One example of a ride involving conveyance of a rider through the air is a swing. Swings can range from the simple variety as commonly used in children's playgrounds to somewhat sophisticated structures requiring mechanisms for raising riders into a launch position from which they are released to swing through a curved trajectory. Whilst swings can provide an entertaining ride, they are generally rather limited in simulating flight, as typically riders only swing back and forth along a curved trajectory. Consequently, the rider achieves essentially the same ride each time.

Another ride involving conveyance of a rider through the air is an aerial carousel, where one or more riders are moved through a generally circular path. Typically, an aerial carousel involves a central column supporting a rotatable hub from which riders are suspended to be conveyed through a circular path about the column, thereby simulating flight. In a simple playground version of such an amusement ride, chains extend from the rotatable hub and have handles (typically configured as rings) attached to their free end so that they can be grasped by the riders. With such rides, the riders initially propel the hub by running around the column while gripping the chains, and thereafter lift their feet from the ground so as to move through the air, simulating flight. In more sophisticated arrangements, the aerial carousels may incorporate rider carriers (such as harnesses or carriages), and also a drive system for driving the hub to cause the rider carriers to move through a circular path around the central column. As with other aerial amusement rides, the ride offered by an aerial carousel is somewhat limited, as the riders merely move through a generally circular path, achieving essentially the same ride each time.

It would be advantageous for there to be an aerial amusement ride which can move a rider through the air but with provision for the ride to be varied should that be desired in order to enhance the sensation experienced by the rider.

DISCLOSURE OF THE INVENTION

According to a first aspect of the present invention there is provided an amusement ride comprising a tower, a hub structure supported on the tower for rotation with respect thereto and for displacement therealong, a first drive means for rotating the hub structure with respect to the tower, a second drive means for displacing the hub structure along the tower, and a rider carrier suspended from the hub structure to undergo motion in response to movement of the hub structure with respect to the tower.

With this arrangement, the rider carrier can undergo motion involving rotation around the tower and also displacement along the tower to provide a change in elevation during the ride. The change in elevation as the rider moves in a path around the tower can enhance the sensation experienced during the ride.

Preferably, the rider carrier is suspended from the hub structure by a flexible suspension link extending therebetween.

The flexible suspension link may comprise at least one flexible line (such as a cable or chain), or a plurality of flexible lines operating in conjunction.

The rider carrier may also be connected to the rotatable hub for swivelling movement with respect thereto. Typically, such an arrangement may be achieved by way of a swivel connection between the flexible suspension link and the rotatable hub. Swivelling movement can provide a further aspect to the sensation experienced during the ride.

Typically, the swivelling movement comprises rotation about an axis corresponding to the longitudinal extent of the flexible suspension link.

Preferably, the amusement ride is adapted to accommodate a plurality of riders at the same time. This may be achieved by the provision of a plurality of rider carriers connected to the rotatable hub in circumferentially spaced relation.

The or each rider carrier may be of any appropriate form such as, for example, a harness structure to receive an support a rider or several riders, or a carriage (such as a chair or pod) in which one or more riders can be accommodated. A rider carrier which can accommodate several riders is advantageous in that there is any opportunity for riders to enjoy the thrill of riding together in a common carrier.

In one arrangement, the rider carrier may be adapted to rotate about an axis transverse to the longitudinal extent of the flexible suspension link. In such an arrangement, the rider carrier may comprise a capsule with seating for accommodating one or more riders.

The rider carrier may be provided with a control device such as a vane or other control surface for imparting rotational motion about the rotational axis during movement of the rider carrier through the air.

There may also be provision for a rider to selectively operate the control device during the ride for providing variation to the ride.

The tower may be a permanent installation or it may be demountable to permit relocation. In another arrangement the tower may be mounted on a trailer and be collapsible onto the trailer for transportation.

The tower may, in one arrangement, comprise a column having a plurality of column sections disposed in series and connected one to another. The column sections may be detachably connected together to facilitate demounting for relocation.

The tower may, in another arrangement, comprise a column having extended and contracted conditions, the column comprising a plurality of column sections moveable one relative to another for moving the column between the extended and contracted conditions. Typically, the column sections are disposed in a telescopic arrangement.

With this arrangement, the column may be pivotally mounted on a trailer whereby the contracted column is pivotally moveable between an upright condition and a collapsed condition folded down onto the trailer for transportation.

Preferably, the tower extends to a height of at least 30 meters. Typically, the tower has a height of about 60 meters, and possibly higher in certain applications.

The hub structure may comprise a plurality of outriggers, one corresponding to each rider carrier, with the flexible suspension link from which each rider carrier is suspended being connected to a respective one of the outriggers. The connection between each suspension flexible link and the respective outrigger may comprise the swivel connection which permits swivelling movement of the rider carrier referred to previously.

Where the tower is collapsible into a folded condition on a trailer, the outriggers are preferably also collapsible into a condition alongside the column.

Preferably the hub structure is rotatably supported on a ring structure adapted for displacement along the tower while being fixed against rotation with respect to the tower.

The first drive means may comprise a drive wheel and a motor for rotating the drive wheel, the drive wheel being in driving engagement with the hub structure, whereby rotation of the drive wheel causes rotation of the hub structure relative to the ring structure.

The second drive means is preferably, operable for selectively causing the ring structure to undergo displacement with respect to the tower.

The second drive means may comprise a cable and pulley system from which the ring structure is suspended, and a winch mechanism, the cable and pulley system comprising a pulley mounted on the tower above the uppermost extent of displacement of the ring structure and a cable having an end thereof connected to the ring structure, the cable extending upwardly from the ring structure, around the pulley and downwardly to be operable by the winch mechanism.

The cable is preferably connected to a counter-weight, the counter weight being connected to the winch mechanism by way of a winch cable.

Preferably, the cable and pulley system comprises a plurality of cables and associated pulleys, each cable being connected at one end to the ring structure, extending upwardly over its respective pulley and downwardly to be operable by the winch mechanism.

Preferably, the counter-weight is accommodated within the open interior of the column.

The design of the amusement ride according to the invention is conducive to construction on a very large scale. As alluded to earlier, it is envisaged that the tower may have a height in excess of 60 meters in certain applications.

BRIEF DESCRIPTION OF THE DRAWINGS

The invention will be better understood by reference to the following description of several specific embodiments thereof as shown in the accompanying drawings in which.

BEST MODE(S) FOR CARRYING OUT THE INVENTION

Figure 1:
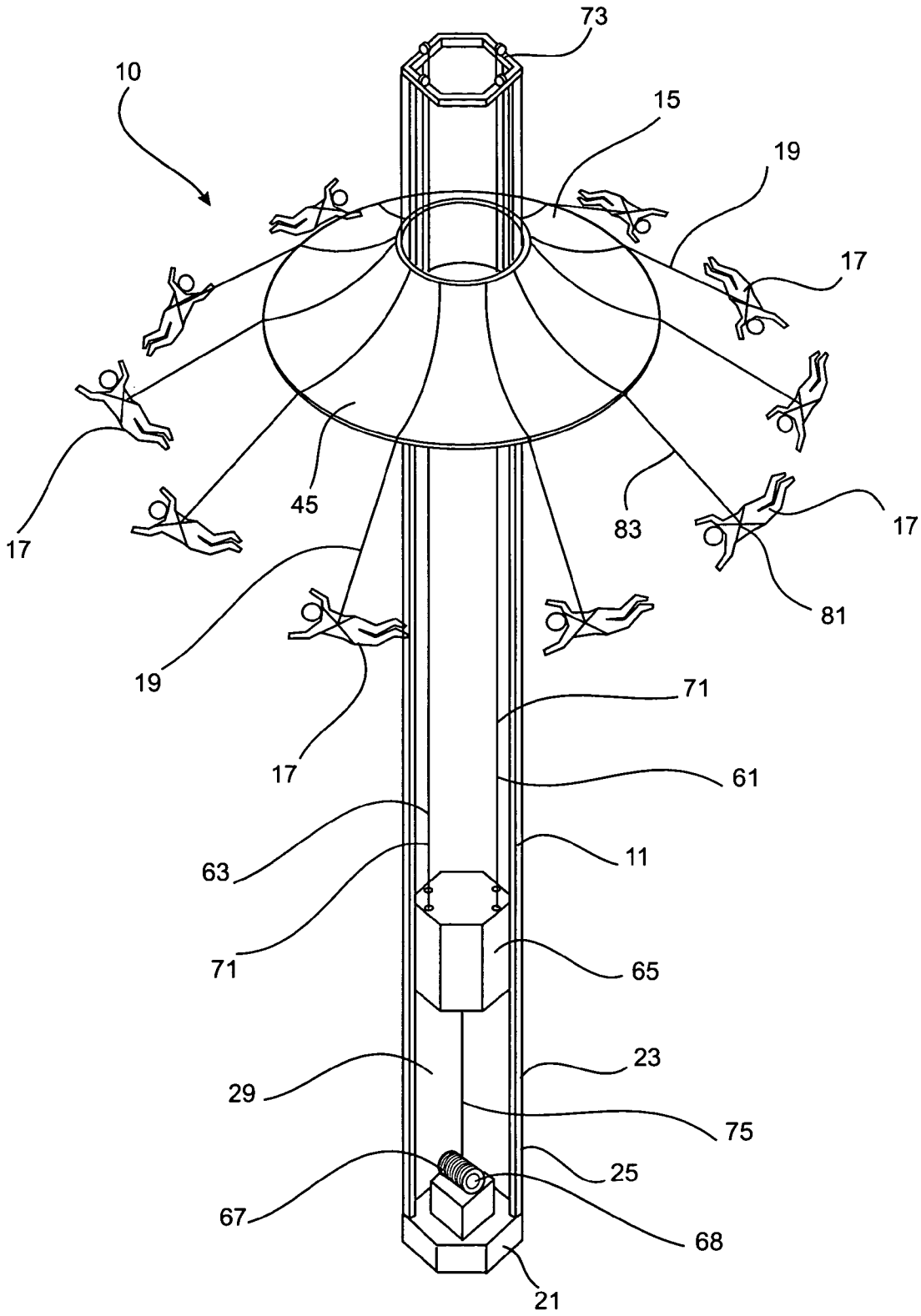
FIG. 1 is a schematic perspective view of an amusement ride according to a first embodiment.
Figure 2:
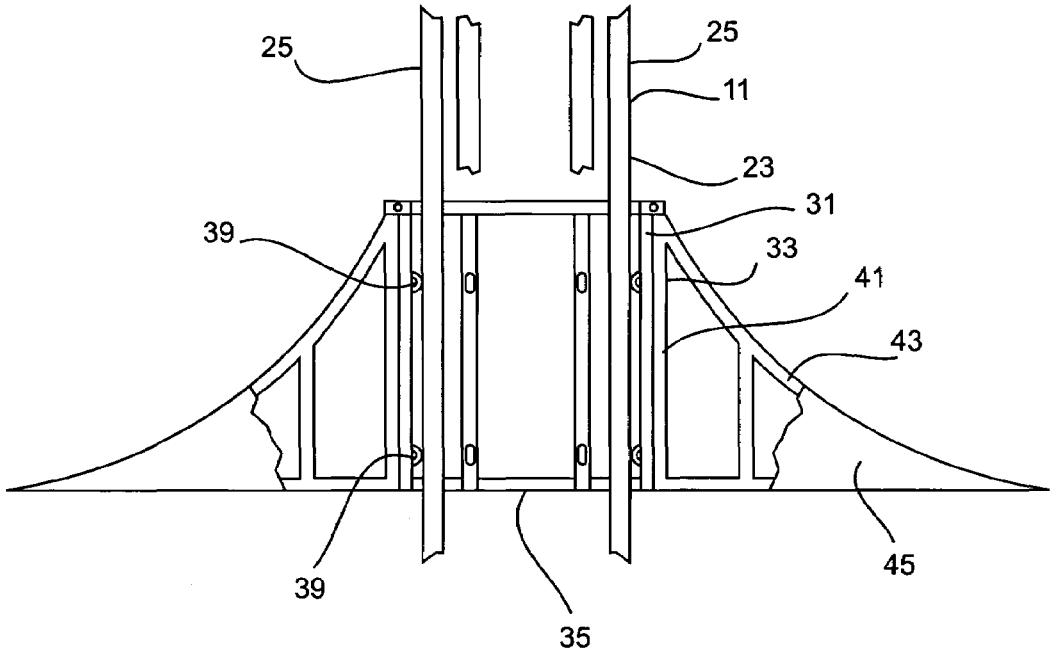
FIG. 2 is a schematic fragmentary side view of the amusement ride, illustrating a support head moveably mounted on a tower.
Figure 3:
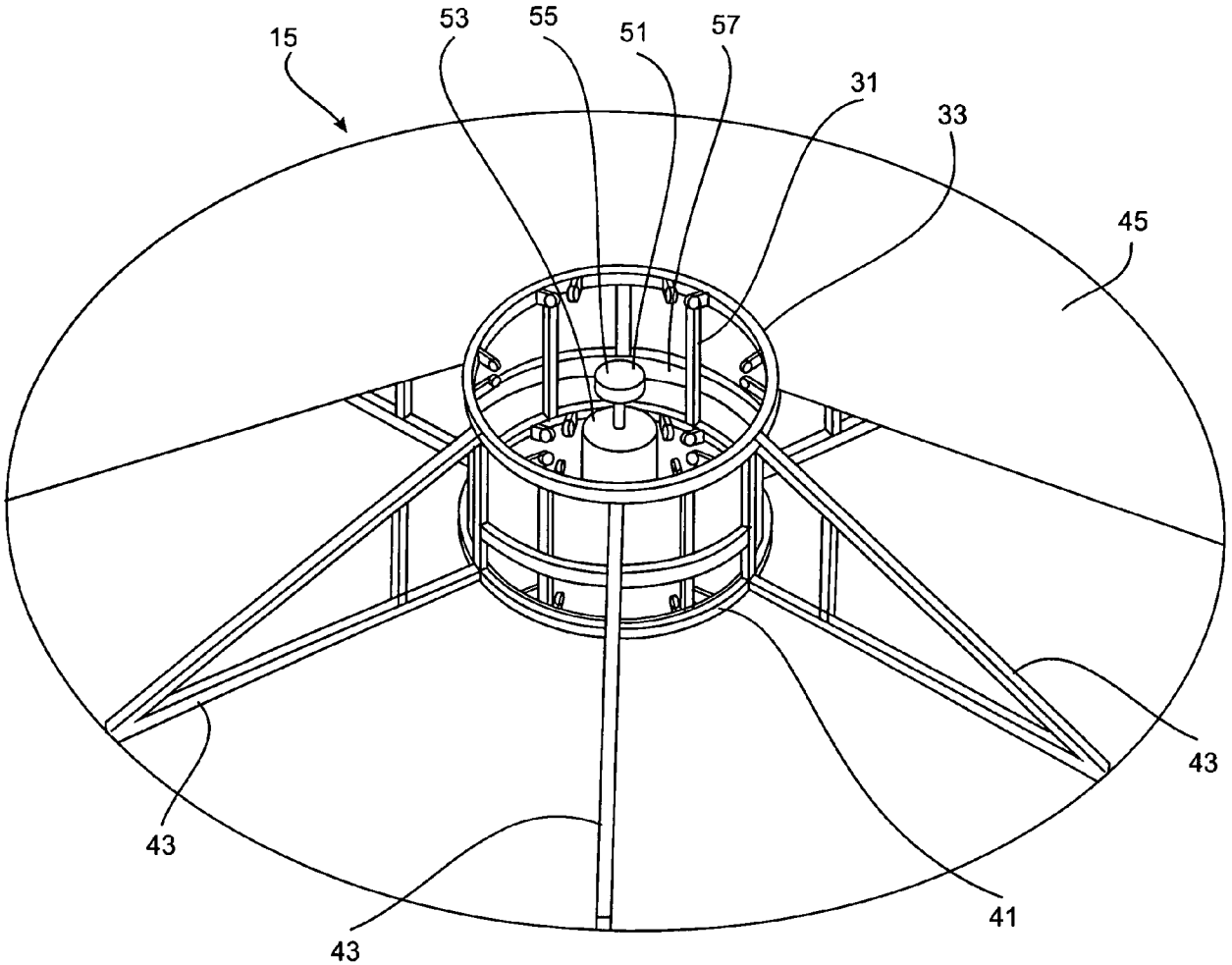
FIG. 3 is a schematic perspective view of the support head.

Referring to FIGS. 1 to 5 of the drawings, there is shown an aerial amusement ride 10 according to a first embodiment. The aerial amusement ride 10 involves conveyance of riders through the air in a manner somewhat simulating flight at an elevation sufficiently high to provide a thrilling sensation.

The aerial amusement ride 10 comprises a tower 11 anchored to the ground 13. A support head 15 is mounted on the tower 13 and riders 17 are suspended from the support head 15 by way of flexible suspension links 19 for conveyance through the air about the tower.

The riders 17 are conveyed along a path which extends around the tower 11, with the elevation of the riders being selectively variable, as will be explained later.

Figure 4:
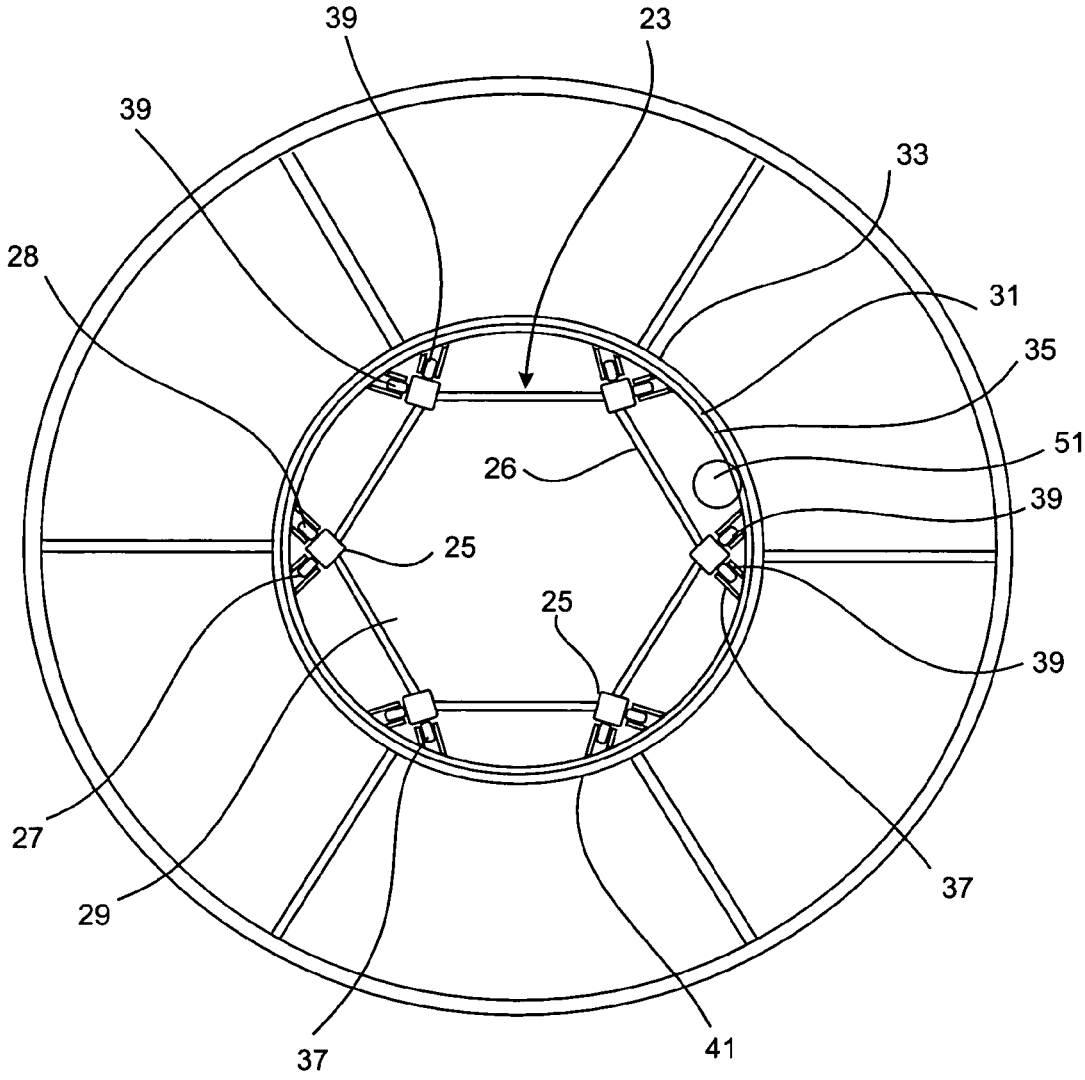
FIG. 4 is a plan view illustrating the support head mounted on the tower.

The tower 11 comprises a base 21 and a column 23 mounted on the base 21. The column 23 is of framework construction, comprising a plurality of longitudinal elements 25 connected one to another by lateral elements 26 which provide bracing, as best seen in FIG. 4 of the drawings. Each longitudinal elements 25 is of rectangular cross-section and is oriented diagonally so that two adjacent faces 27, 28 thereof are outwardly facing, as best seen in FIG. 4.

While not shown in the drawings, the column 23 in this embodiment comprises a plurality of column sections disposed in series one upon another, with adjacent sections being detachably connected together. With this arrangement, the height of the column, which is a matter of design choice, can be established by using an appropriate number of column sections. Additionally, the arrangement facilitates erection of the column 23, as it is merely necessary to fit one column section upon another, typically with the assistance of a crane or other suitable load lifting apparatus.

Because of the framework construction of the column 23, there is an open space 29 defined within the column.

The support head 15 comprises an inner ring structure 31 adapted for displacement along the column 23 while being fixed against rotation with respect thereto, and an outer hub structure 33 rotatably supported on the inner ring structure 31.

The inner ring structure 31 is mounted on the column 23 for guided rolling movement therealong. Specifically, the inner ring structure 31 comprises a peripheral frame 35 of generally circular construction extending around the column 23. A plurality of sets of rollers 37 are mounted on the frame 35 in two groups spaced one with respect to the other in the longitudinal direction of the column 23. The roller sets 37 in each group are circumferentially spaced around the column 23, with each roller set 37 corresponding to one of the longitudinal elements 25 of the column 23. Each roller set 37 comprises two rollers 39 positioned for rolling engagement against respective outer adjacent faces 27, 28 of the corresponding longitudinal element 25, as best seen in FIG. 4. This is achieved by supporting the rollers 39 in each set with their axis of rotation substantially at 90 degrees with respect to each other. With this arrangement, the respective longitudinal element 25 defines a track and the faces 27, 28 define two track surfaces, with each roller 39 in the roller set 37 engaging a respective one of the track surfaces. The orientation of the two rollers 39 in each roller set 37 and also the track surfaces, ensures that the ring structure 31 is supported for guided rolling movement along the column 23 while being restrained against rotation around the column.

The hub structure 33 comprises a hub frame 41 of generally circular construction rotatably mounted on the ring structure 31, and a plurality of outriggers 43 extending from the hub frame 41.

A canopy covers the hub structure 33. The canopy 45 is shown partly cut-away in FIGS. 2 and 3.

A first drive means 51 is provided for rotating the hub structure 33 with respect to the ring structure 31, thereby rotating the hub structure 33 with respect to the column 23. The drive means 51 comprises an electric motor 53 and a drive wheel 55 drivingly connected to the motor 53. The electric motor 53 is supported on the inner ring structure 31 and the drive wheel 55 is in driving engagement with a drive ring 57 mounted on the hub frame 41. In this embodiment, the drive wheel 55 comprises a rubber wheel which is adapted to frictionally engage the drive ring 57, whereby rotational torque applied to the drive wheel 55 is transmitted to the hub structure 33 through frictional engagement between the drive wheel 55 and the drive ring 57 mounted on the hub frame 41.

A second drive means 61 is provided for displacing the support head 15, and thus the hub structure 33 forming part thereof, along the column 23. The second drive means 61 comprises a cable and pulley system 63 from which the support head 15 is suspended, together with a counter-weight 65 and a winch mechanism 67.

The cable and pulley system 63 comprises a plurality of cables 71 (there being four such cables in this embodiment). One end of each cable 71 is attached to the ring structure 31 of the support head 15 and the other end of each cable is connected to the counter-weight 65. Each cable 71 passes over a respective pulley 73 mounted on the column 23 at a location above the uppermost extent of displacement of the support head 15. From the connection to the support head 15, each cable 71 passes upwardly to be routed around its respective pulley 73 and then extends downwardly to the counter-weight 65. The counter-weight 65 is connected to the winch mechanism 67 by way of a winch cable 75. The winch mechanism 67 incorporates a winch drum 68 about which the winch cable 75 can be wound and unwound.

The counter-weight 65 is selected such that the support head 15 can travel downwardly under the influence of gravity, with its weight partly being compensated by the counter-weight 65. The rate of decent of the support means 15 on the column 23 is controlled by the rate at which the winch cable 75 is unwound from the winch mechanism 67. The winch mechanism 67 incorporates a disc brake (not shown) operation of which can regulate the rate at which the winch cable 75 is unwound.

Operation of the winch mechanism 67 to wind the winch cable 75 about the winch drum pulls the counter-weight 65 downwardly thereby pulling the support head 15 upwardly through the cable and pulley system 63.

The counter-weight 65 is accommodated within the open space 29 within the framework defining the column 23. This provides for compactness of construction and also allows the longitudinal elements 25 within the column 23 to be used for the purposes of guiding movement of the counter-weight as it moves upwardly and downwardly corresponding to displacement of the support head 15. To this end, the periphery of the counter-weight 65 is configured so that the counter-weight can be accommodated within the open space 29 for guided movement therealong by the longitudinal elements 25.

Compactness of construction is further achieved by positioning the winch mechanism 67 on the base 21 and also within the open space 29 defined by the column 23.

Accordingly, both the counter-weight 65 and the winch mechanism 67 are accommodated within the confines of the tower 13.

The riders 17 are accommodated in rider carriers 81 which are suspended from the outriggers 43 by way of the flexible suspension links 19. Each flexible suspension link 19 comprises a flexible line 83 which in this embodiment is in the form of a cable or chain, with one end of the flexible line 83 being connected to a respective one of the outriggers 43 and the other end of the flexible link 83 being connected to a respective rider carrier 81.

In this embodiment, the rider carriers 81 comprise harness structures in which the riders 17 can be accommodated. Other types of rider carriers are of course possible, including carriages in the form of seats or pods accommodating one or more riders.

While the harness structures defining the rider carriers 81 in the embodiment each accommodate a single rider, it is possible to utilise a tandem or other multiple harness in which several riders may engage in the thrill of riding together in a common carrier.

The connection between each suspension line 83 and its respective rider carrier 81 may incorporate a swivel to permit the rider to twist around an axis corresponding to the longitudinal extent of the suspension line. In this way, the rider has the option of twisting or otherwise manipulating his or her body around in order to provide further variety to the ride and thus enhance the sensation experienced during the ride.

Figures 5A, 5B, 5C, 5D:
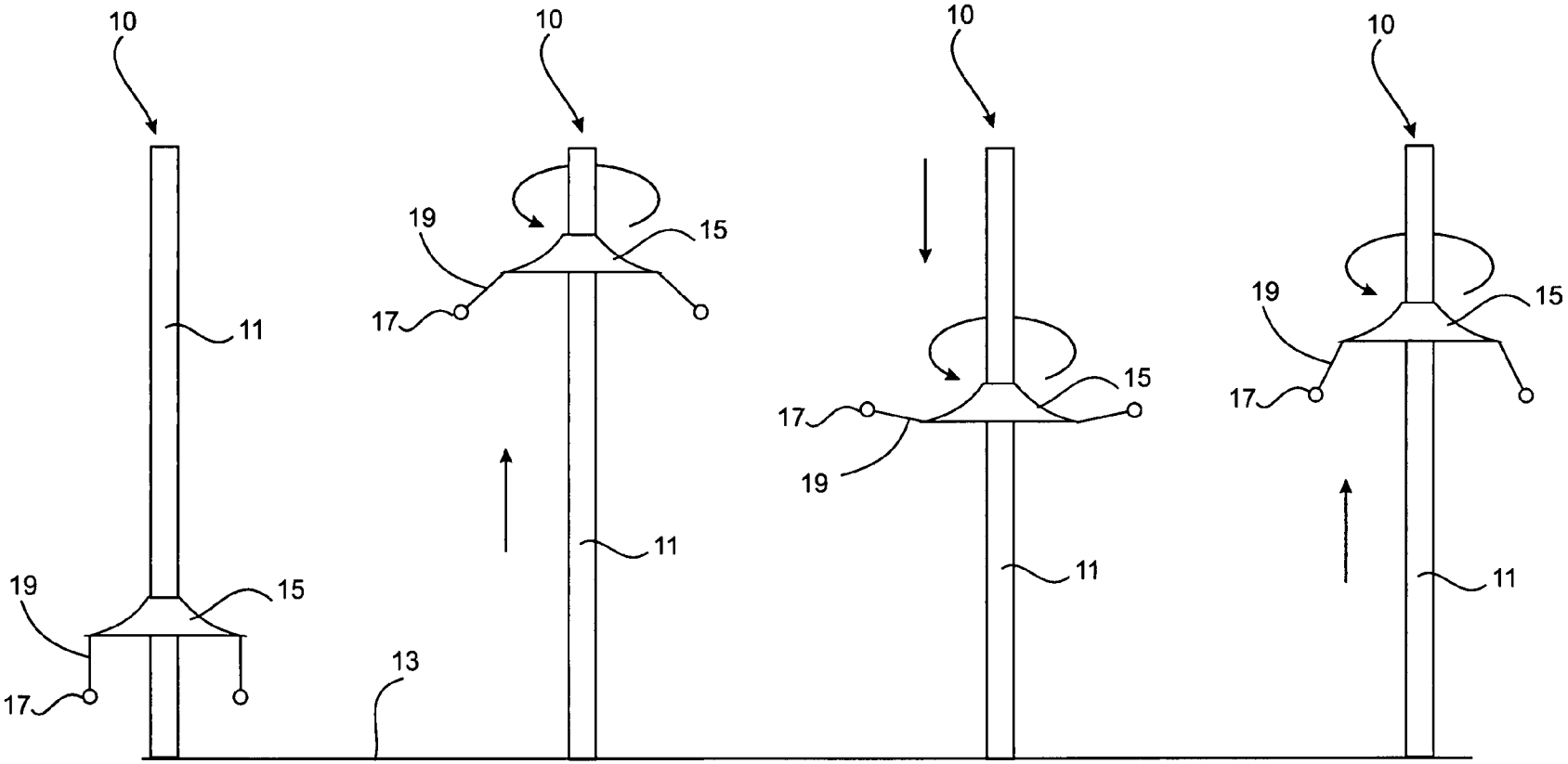
FIGS. 5*a* to 5*d* are schematic side elevational views illustrating the amusement device in various stages of operation.
Figure 6:
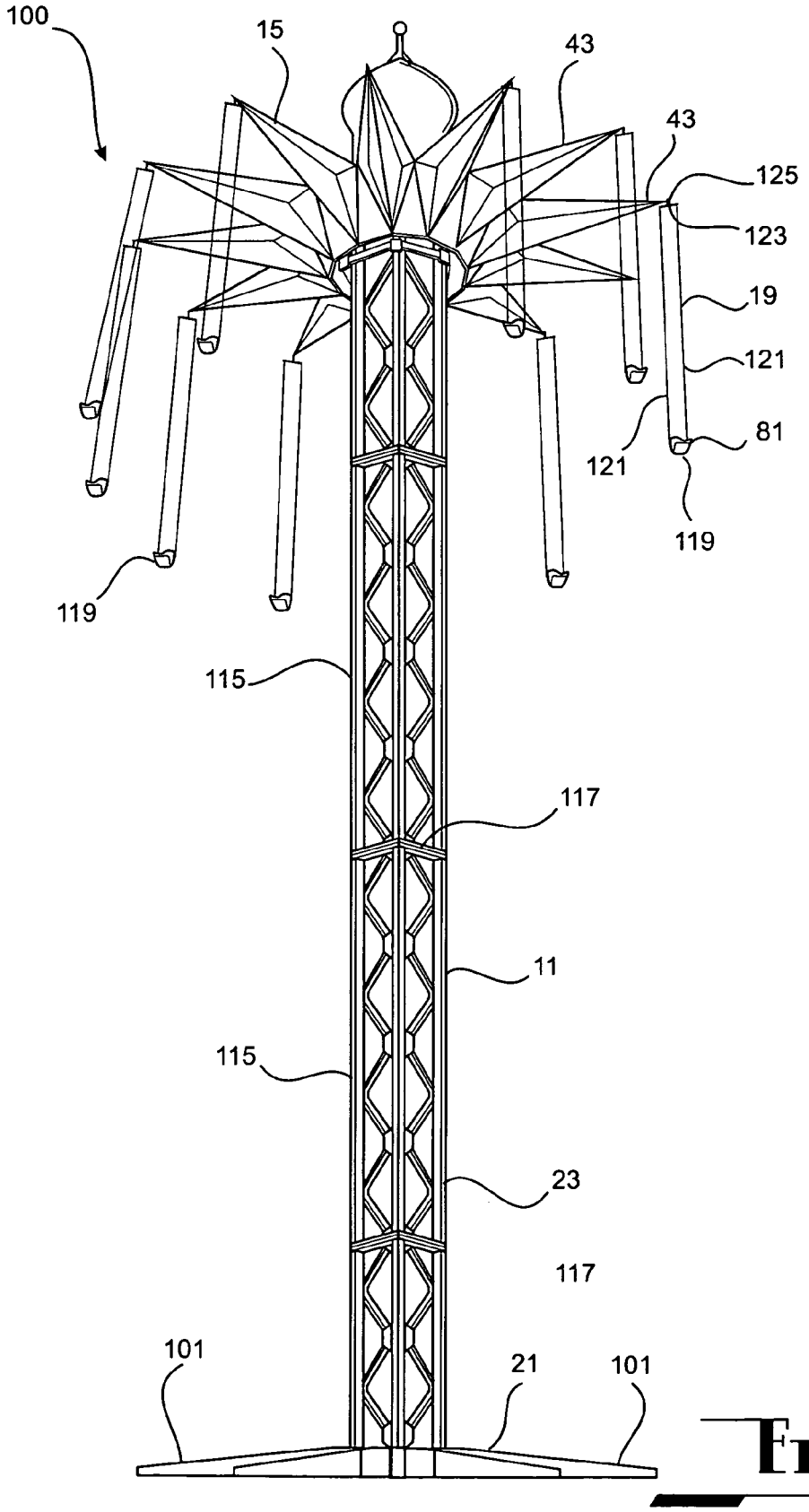
FIG. 6 is a schematic perspective view of an amusement ride according to a second embodiment.
Figure 7:
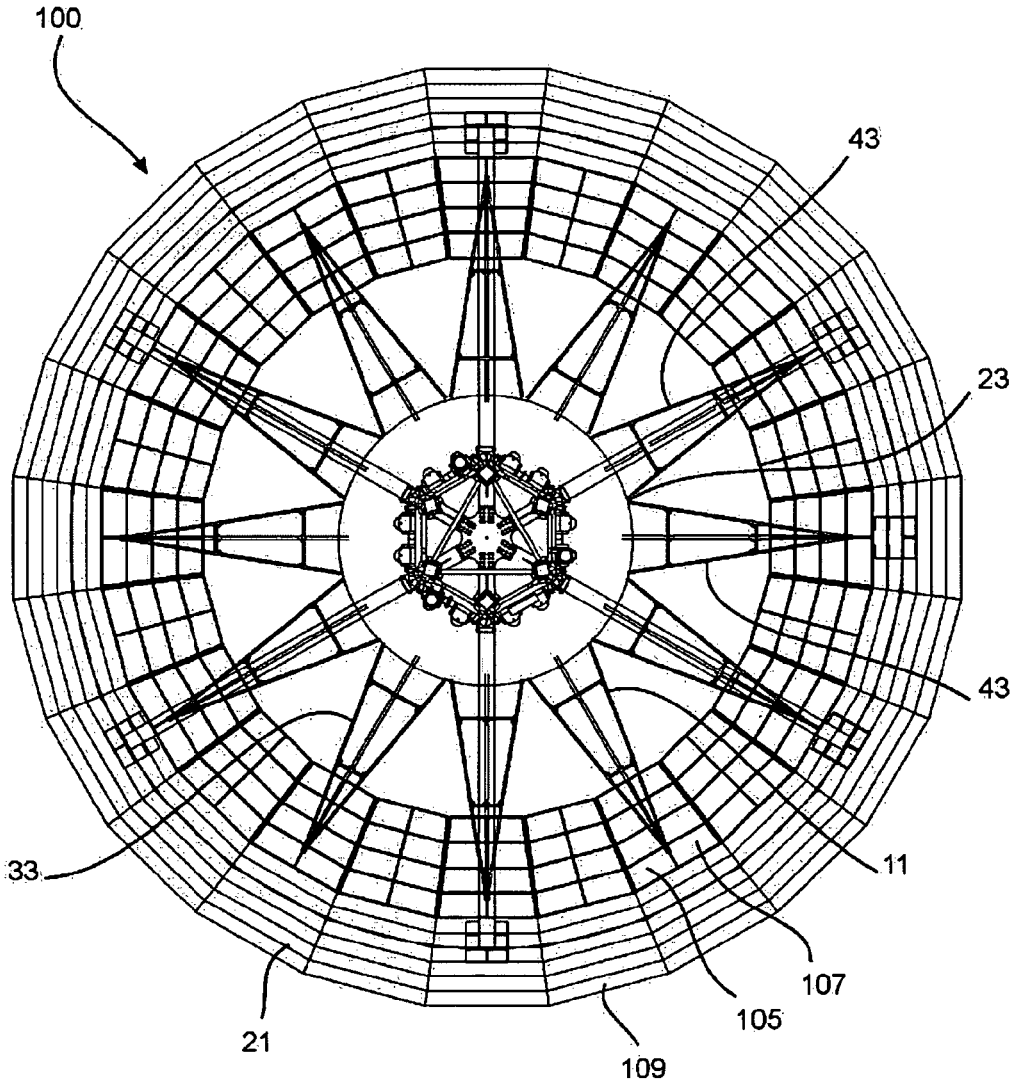
FIG. 7 is a plan view of the amusement ride of FIG. 6.

Operation of the ride according to the first embodiment will now be described. The ride commences with the riders 17 at ground level or at an appropriate loading station near ground level, as shown in FIG. 5*a*. The support head 15 is lowered by operating the winch mechanism 67 to unwind the winch cable 75 from the winch drum 68. Once the support head 15 has been lowered sufficiently so that the riders 17 can be accommodated in the rider carriers 81 and appropriately secured in position, the winch mechanism 67 is operated to wind in the winch cable 75, thereby pulling the counterweight 65 downwardly and thus causing the support head 15 to move upwardly along the column 23, as illustrated in FIG. 5*b*. During the upward ascent, and once the riders 17 are sufficiently clear of the ground or loading station as well as any other obstacles, the first drive means 51 can be actuated so as to cause the hub structure 33 to rotate about the column 23. This causes the riders 17 to swing outwardly on the suspension lines 83 and move through a somewhat circular path around the column 23, also as shown in FIG. 5*b*. During the ride, the support head 15 can be lowered as illustrated in FIG. 5*c* and raised as illustrated in FIG. 5*d* in order to change the elevation of the riders as they move through the circular path about the column 23. The speed of rotation of the hub structure 23 can also be varied if desired to provide variation to the ride characteristics. Typically, the hub structure 33 rotates at about 10 rpm in this embodiment. The displacement of the support head involving movement upwardly and downwardly during the ride may be at speeds up to about 5 m/s.

During the ride, the support head 15 can be lowered at a rate faster than the riders 17, thus providing situations where the riders 17 may be higher than the points at which they are attached to the ride.

The variation in elevation during the revolving motion of the riders provides an exciting ride, particularly when regard is had to the significant height at which the ride is conducted. Further variation is available to the riders 17 during the ride through swivelling movement at the connection between the suspension line 83 and the rider carrier 81. To complete the ride, the support head 15 is lowered so as to return the riders 17 to the ground or loading platform.

Referring now to FIGS. 6 to 10 of the drawings, there is shown an amusement ride 100 according to a second embodiment. The amusement ride 100 is similar in many respects to the amusement ride 10 according to the first embodiment and corresponding reference numerals are used to identify similar parts.

The tower 11 comprises a base 21 and a column 23, as was the case in the first embodiment. In this embodiment, the base 21 comprises a plurality of legs 101 extending radially outwardly, with anchoring pads 103 provided on the outer ends of the legs 101 for engagement with the ground 13. The base 21 also incorporates a station 105 at which riders are loaded onto, and unloaded from, the ride. The station 105 comprises a platform 107 which extends around the tower 11 and which is accessible by way of stairs 109.

The base 21 also incorporates a portion 111 extending downwardly, accommodated within a hole 113 formed in the ground.

The column 23 is of framework construction and is formed in column sections 115 connected one to another at junctions 117.

In this embodiment, the rider carriers 81 comprise chair structures 119 which may be fitted with an appropriate restraint system for the purposes of restraining riders in position during operation of the ride.

The flexible suspension link 19 suspending each rider carrier 81 to a respective outrigger 43 comprises a pair of flexible lines 121 such as cables or chains. The flexible lines 121 are connected at their upper end to a crossbar 123 which in turn is connected to the respective outrigger 41 by way of swivel connection 125.

Figure 8:
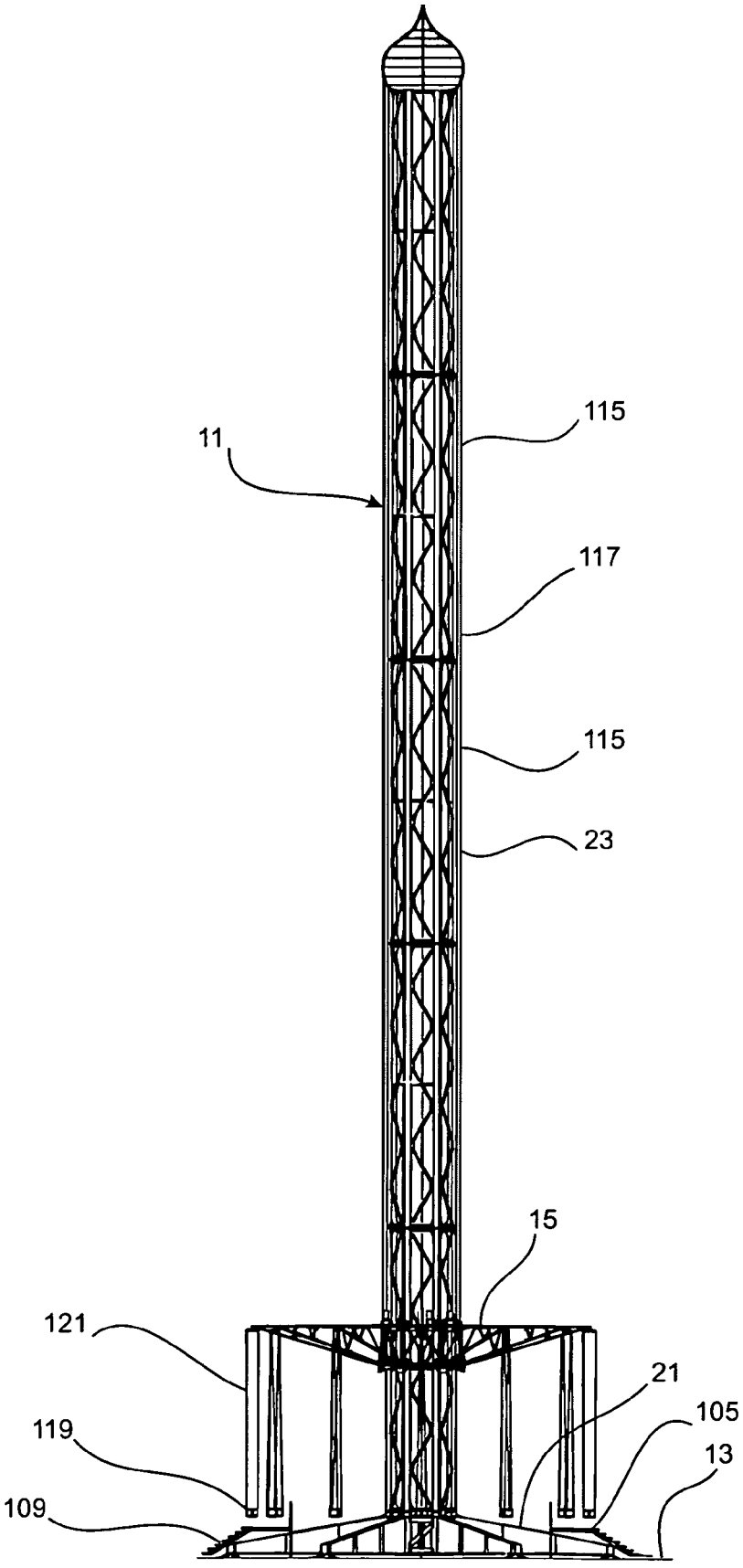
FIG. 8 is a schematic side elevational view of the amusement ride, with the support head shown in a lowered condition.
Figure 10:
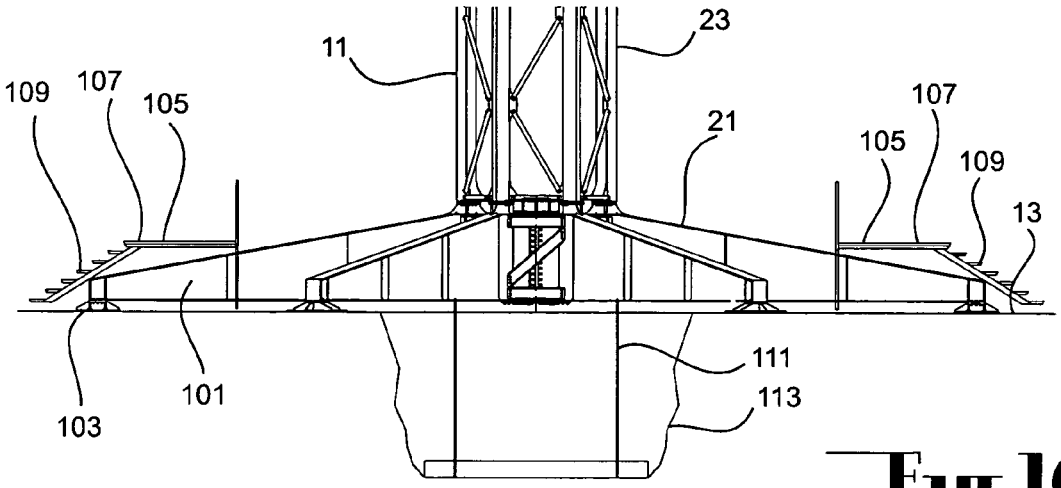
FIG. 10 is a fragmentary elevational view of the lower end of the tower.
Figure 9:
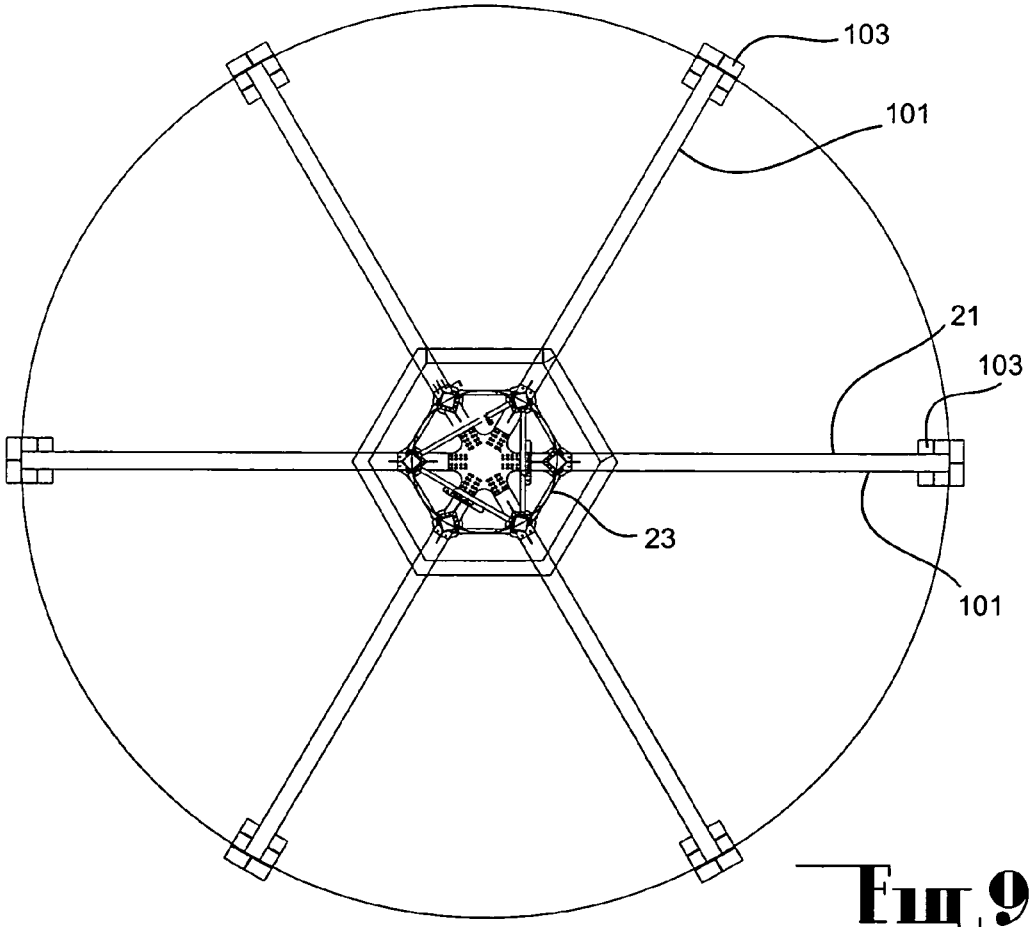
FIG. 9 is a plan view of the tower forming part of the amusement ride according to the second embodiment.

Operation of the amusement ride 100 according to the second embodiment is similar to that of amusement ride 10 according to the first embodiment, with the ride commencing with the support head 15 lowered into a position at which riders can enter the chairs 119 at the station 105, as shown in FIG. 8 of the drawings. The support head is then raised into an operative condition and rotated and displaced in a similar fashion to the first embodiment.

In this embodiment, all chairs 119 are accommodated at the station 105 at the same time. Thus, riders enter and leave the various chairs 119 at the station at the same time.

In an alternative arrangement, the station may be at a specific location, with the chairs 119 moving sequentially into and out of the station. With such an arrangement, the drive means for rotating the support head 15 can be utilised to rotate the chairs in an indexing fashion, with the chairs moving into and out of the station one after another. This can be advantageous in that the ride operator would than be in a better position to exercise control over the loading and unloading process, particularly with regard to the manner in which riders enter and leave each chair.

The amusement ride 100 according to the second embodiment has been designed so that it is conducive to construction on a very large scale. Indeed, the tower 11 is approximately 60 meters in height and the diameter of the rotatable support head 15 is approximately 18 meters. The enormous size of the amusement device ensures that the riders are exposed to an extreme height during the ride, thereby enhancing the sensation experienced during the ride.

Figure 11:
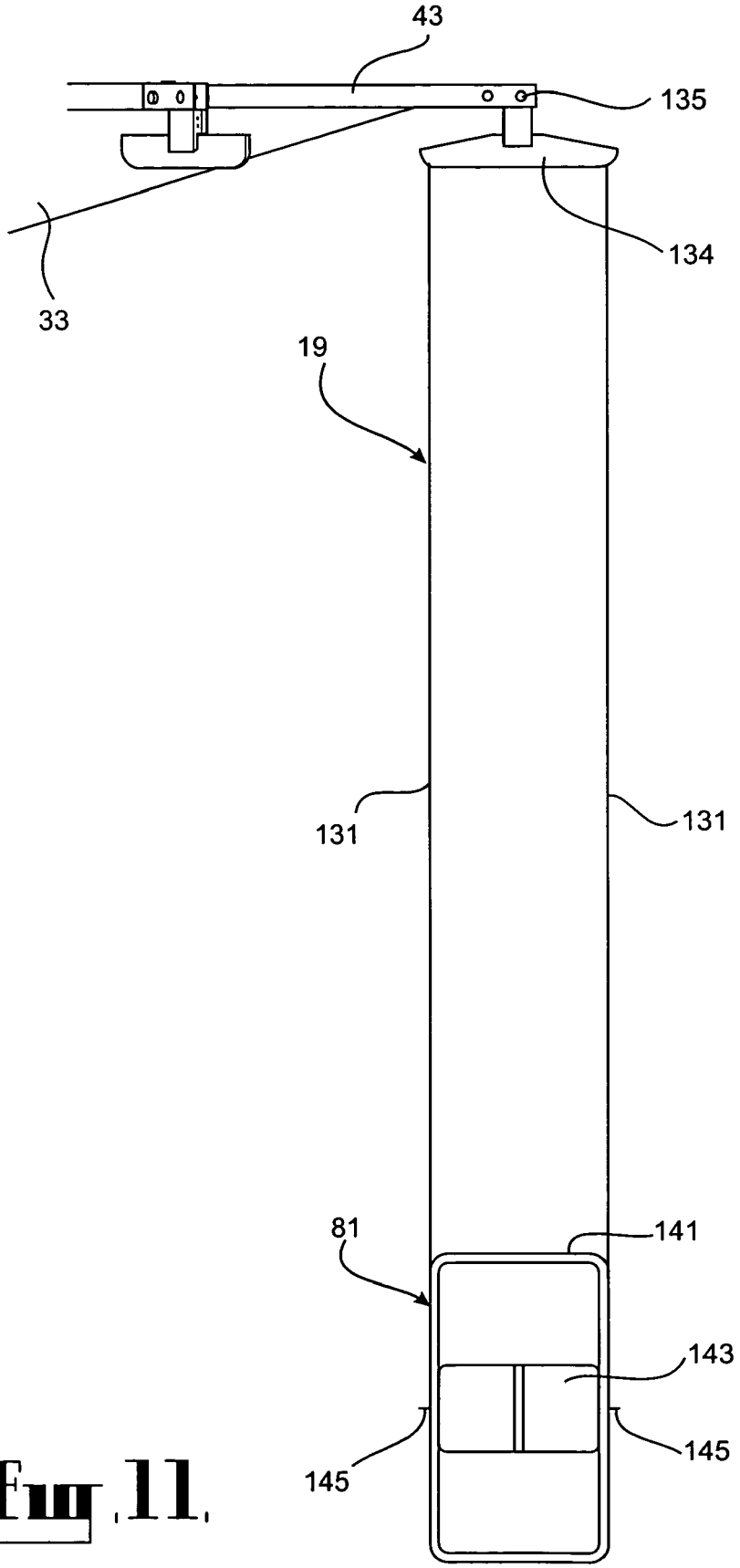
FIG. 11 is a fragmentary view illustrating a rider carrier and suspension link for an amusement ride according to a third embodiment.
Figure 12:
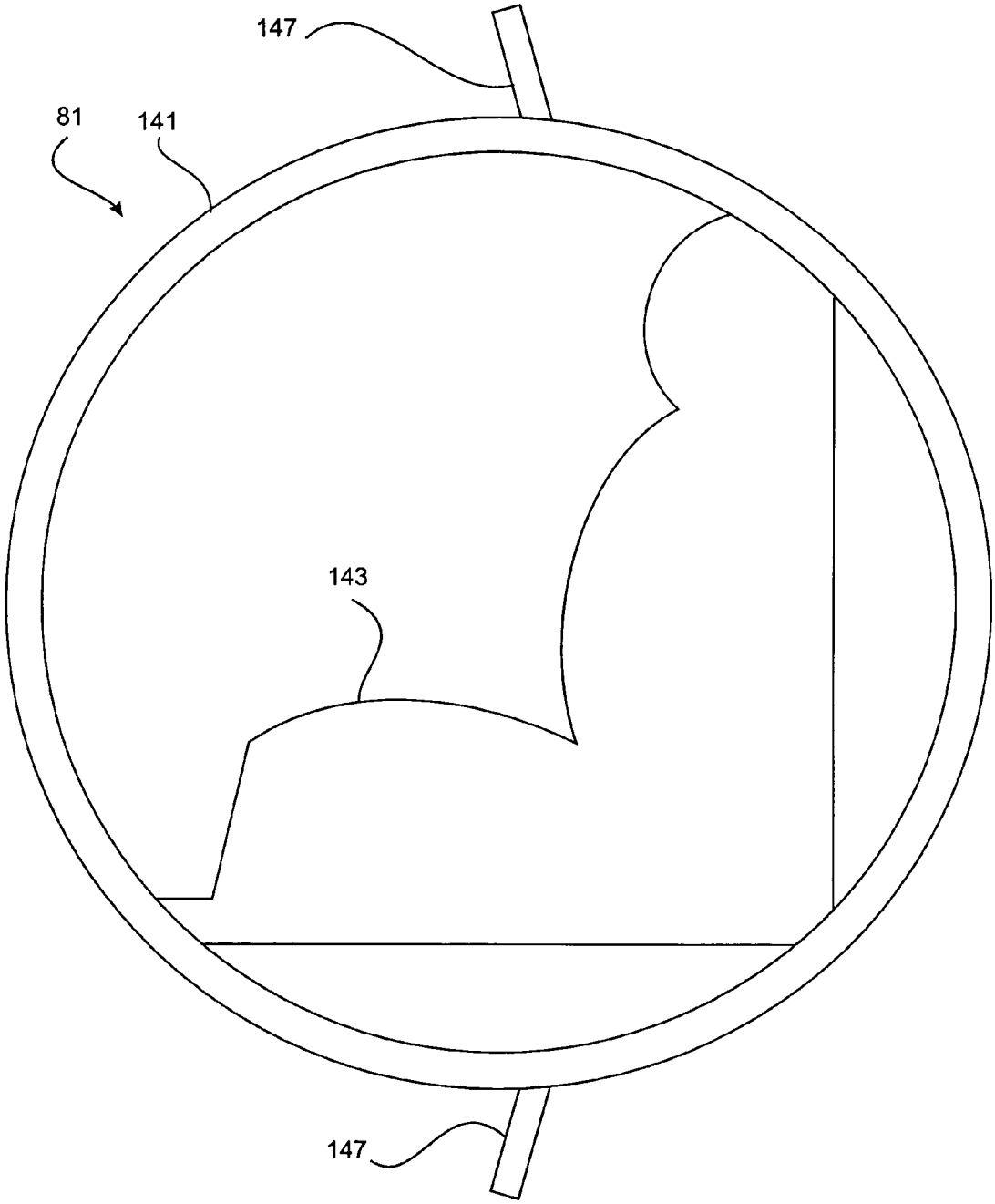
FIG. 12 is a schematic view of a capsule defining the rider carrier shown in FIG. 11.

Referring now to FIGS. 11 and 12, there is shown a rider carrier 81 and a flexible suspension link 19 for an amusement ride according to a third embodiment. The flexible suspension link 19 comprises two lines 131 suspended from a cross member 133 connected by pivot connection 135 to outrigger 43. The pivot connection 135 facilitates outward swinging motion of the rider carrier. The rider carrier 81 comprises a capsule 141 in which several riders can be accommodated. The capsule 141 incorporates seating 143 for riders in the capsule. The capsule 141 is rotatable supported between a two trunnions 145, with each trunnion 145 being connected to one of the lines 131. With this arrangement, the trunnions 145 define a rotational axis about which the capsule 141 can rotate. The capsule 141 has an outer periphery fitted with control devices 147 in the form of vanes, as shown in FIG. 12. The vanes 147 cause the capsule 141 to rotate about the rotational axis upon movement of the capsule through the air with rotation of the hub structure 33. The angle of attack of the vanes 147 determines the speed of rotation of the capsule. The direction of rotation may be altered by altering the attitude of the vanes; that is, by facing them in an opposite direction relative to the rotational axis of the capsule. There may be provision for a rider to selectively move one or both of the vanes for the purposes of controlling the direction and speed of rotation of the capsule. The control may be achieved by way of a lever mechanism located within the capsule 141 and operatively connected to one or both vanes. This presents the rider with an opportunity to control his or her own ride, thereby providing variation to the ride and further enhancing the sensation experienced on the ride.

There may also be provision for locking the capsule 141 against rotation during the ride. The locking mechanism may be controlled by the ride operator who may provide the rider with the choice as to whether or not the rotational function will be employed during the ride.

The rotatable capsule provides a further axis of rotation during the ride, providing variety and thus a generally more exciting ride. The feature may also be conducive to repeat business, as riders may wish to develop their skills over time in controlling the ride.

In the embodiments previously described, the amusement rides are not readily transportable from one location to another. In particular, each embodiment has the tower thereof anchored to the ground. This is appropriate for amusement rides intended to be permanent installations, such as for instance in amusement parks. However, there is a need for an amusement ride that can be transported from one location to another according to demands and opportunities presented for the amusement ride. Such an amusement ride would be particularly advantageous for use at temporary amusement sites, such as those created in public open space, fairgrounds, parklands, and parking areas and other spaces at shopping centres.

An amusement ride can be provided with mobility by appropriate design to facilitate ready disassembly into a condition for road transport such as by incorporating the ride onto a transport vehicle such as a trailer. However, many jurisdictions only allow one trailer and so it would be advantageous for the amusement ride to be incorporated on a single trailer. The fourth embodiment, as shown in FIGS. 13 to 28, provides such an amusement ride.

Referring now to FIGS. 13 to 29, there is shown a mobile amusement ride 150 incorporated on a trailer 165. The amusement ride 150 comprises a tower 151 and a support head 153 mounted on the tower 151. Riders 155 can be suspended from the support head 153 by way of flexible suspension links 157 such as cables for conveyance through the air about the tower. The riders 155 are carried in rider carriers 158 attached to the ends of the flexible suspension links 157. In this embodiment, the rider carriers 158 comprise harnesses. However, the rider carriers may take any other appropriate form such as seat structures and gondolas.

The tower 151 comprises a column 161 mounted on a base 163 incorporated into the trailer 165.

Figure 20:
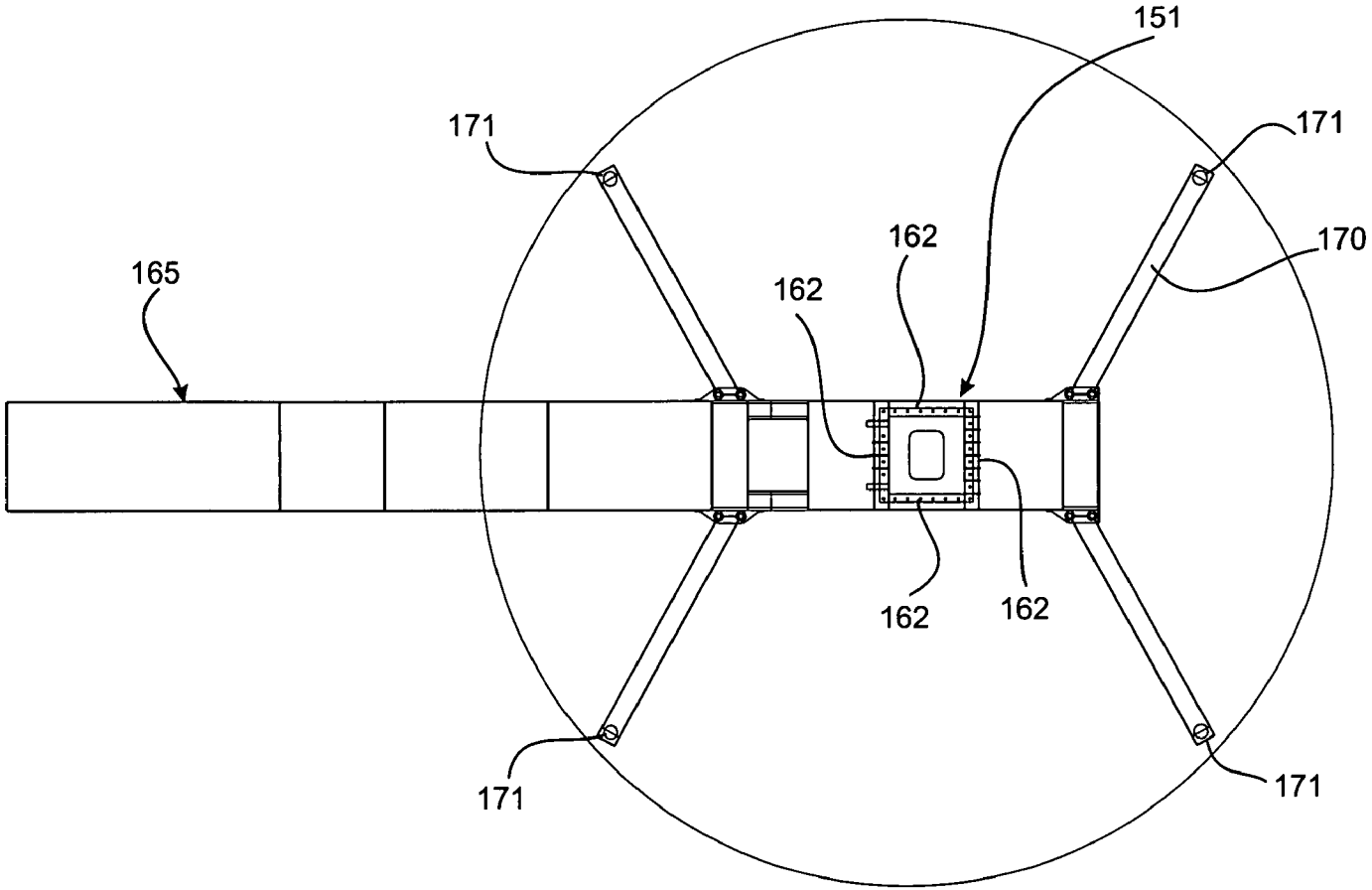
FIG. 20 is a schematic plan view of the amusement ride of FIG. 13, illustrating in particular deployed outrigger legs for the trailer.
Figure 21:
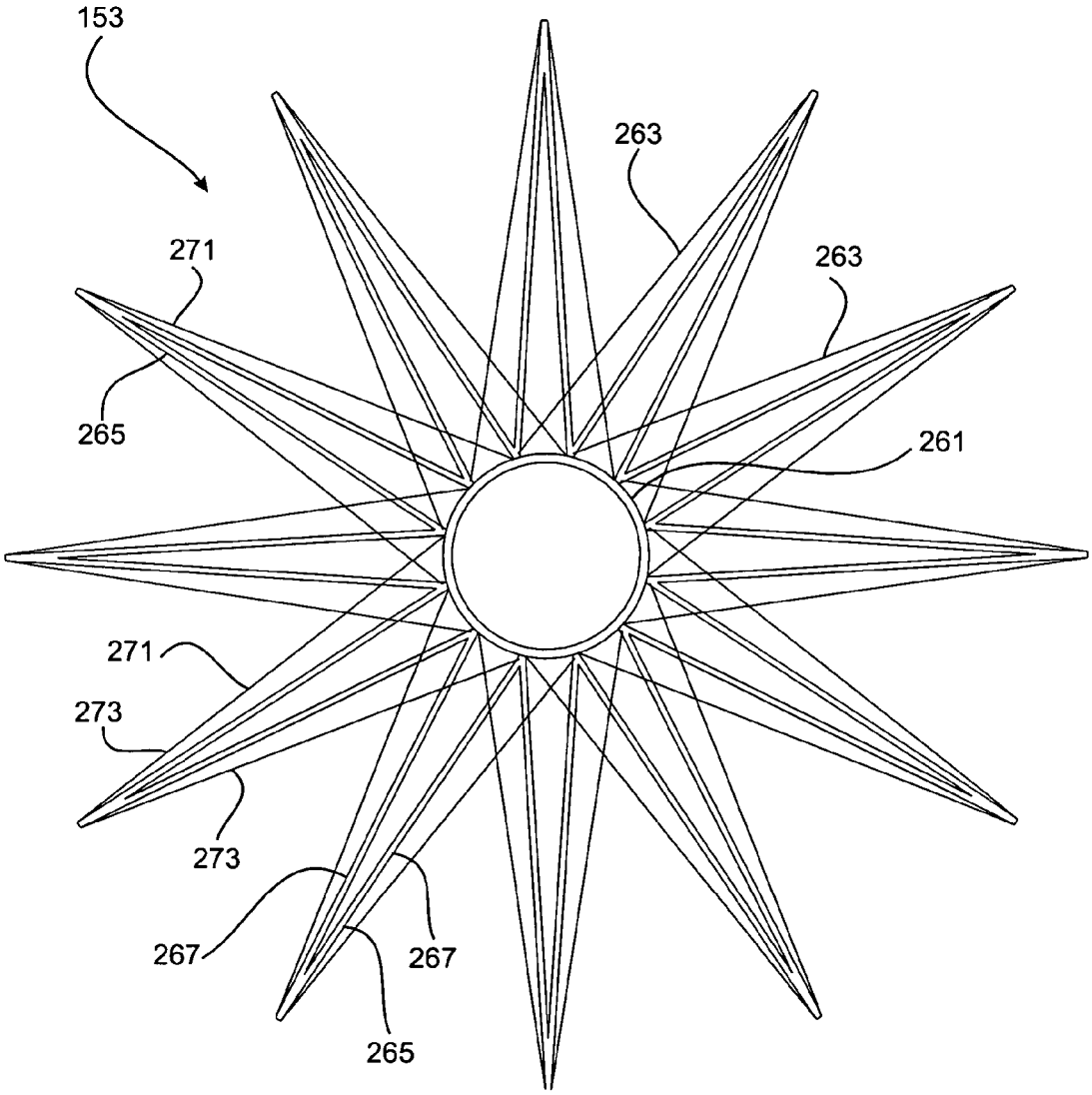
FIG. 21 is a schematic plan view of a support head mounted on the tower, the support head incorporating outriggers from which riders are suspended.

The trailer 165 is of conventional construction, involving a frame structure 167 carried on wheels 169. The frame structure 167 has facility at the forward end thereof for attachment to a towing vehicle. The frame structure 167 incorporates a stabiliser system 170 comprising retractable outrigger legs 171, as best seen in FIG. 20, for engagement with the ground 172 to stabilise the trailer 165 when the amusement ride is operational.

Figure 13:
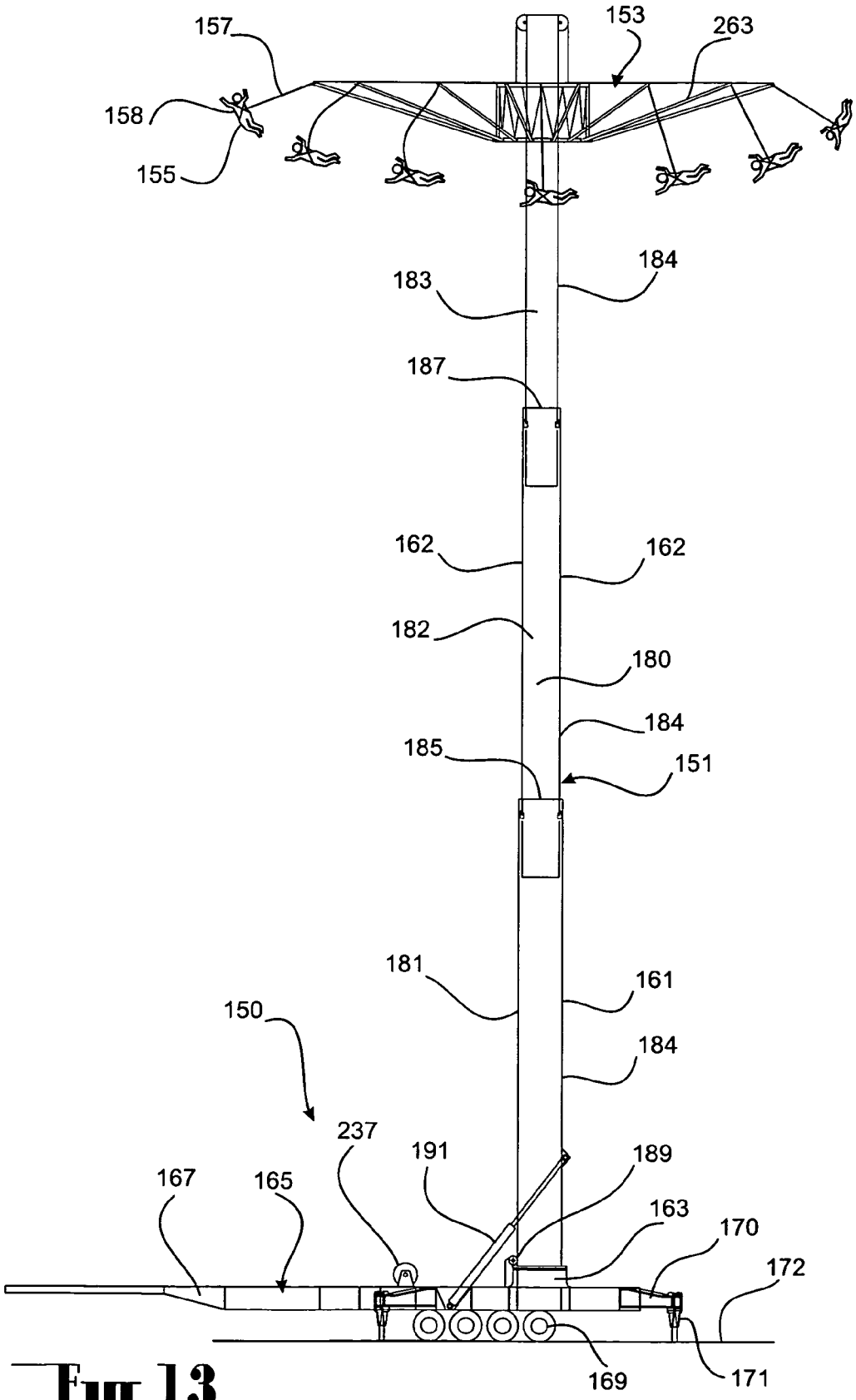
FIG. 13 is a schematic elevational view of an amusement ride according to a fourth embodiment.

The amusement ride 150 is selectively moveable between an operational condition and a collapsed condition on the trailer 165 for transport. When the amusement ride 150 is in the operational condition, the column 161 occupies an upright condition, extending upwardly from the base 163, as shown in FIG. 13.

The column 161 is of telescopic construction, comprising a plurality of column sections 180 moveable one with respect to another to provide extended and contracted conditions for the column. In this embodiment, there are three column sections 180, being a first column section 181, a second column section 182 and a third column section 183. The first column section 181 is lowermost and the third column section 183 is uppermost, with the second column section 182 being intermediate the other two column sections. The first section 181 receives the intermediate section 182 which in turn receives the upper section 183 as the column 161 moves from the extended condition into the contracted condition. In the contracted condition of the column 161, the various column sections 180 are in a nested arrangement.

Figure 19:
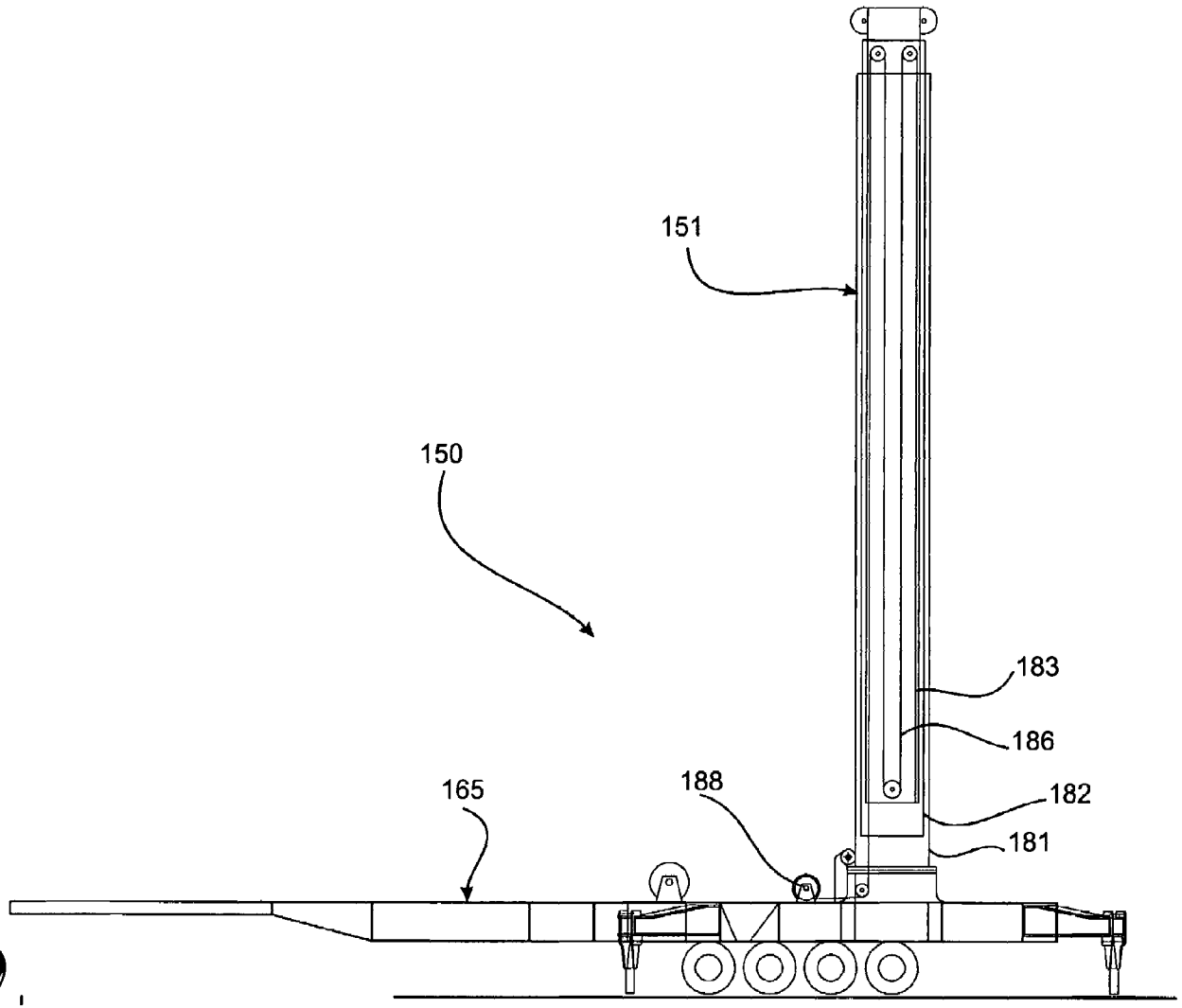
FIG. 19 is a schematic side view of the tower mounted on the trailer, showing in particular the mechanism for extending and contracting the tower.

Cable and pulley system 186 is provided for controlling extension and contraction of the column 161. The system 186 operates in conjunction with winch 188 mounted on the trailer, as shown in FIG. 19.

In this embodiment, the column 161 is of rectangular cross-section, comprising four longitudinal outer sides 162. The column sections 180 have outer faces 184 which co-operate to form the four column sides 162. With the column 161 being of telescopic construction, the various column sections 180 necessarily have different lateral dimensions and consequently there are two steps 185, 187 present in the outer sides 162 at the locations of overlap between the respective column sections 180. In this embodiment, the lateral dimensions of each column comprise width and depth, represented by the spacing between opposed sides thereof.

Figure 14:
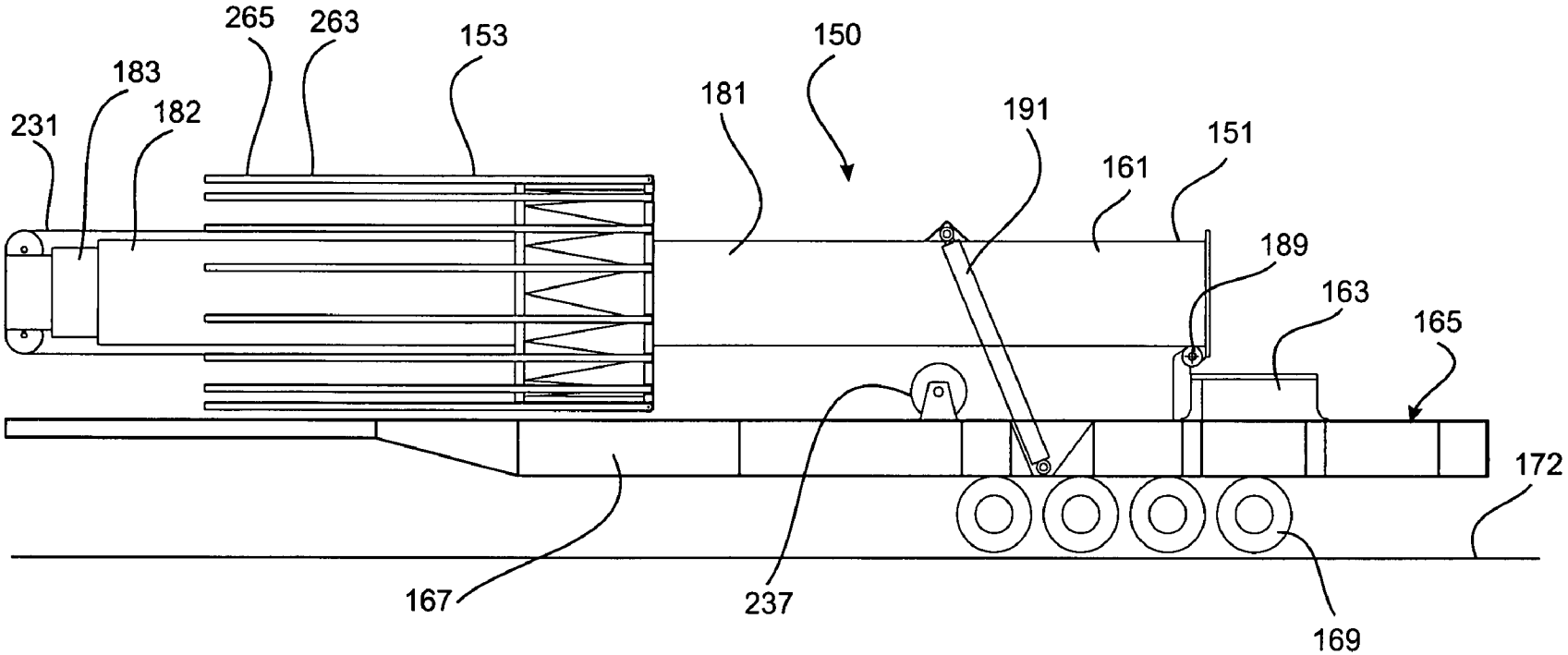
FIG. 14 is a schematic side elevational view of the amusement ride of FIG. 13 shown in a collapsed condition for transport.

The column 161 is hingedly mounted at hinge 189 to the base 163 for pivotal movement into the collapsed condition whereby the contracted column is folded down into a compact arrangement on the trailer, 165 as best seen in FIG. 14 of the drawings.

A power device in the form of a hydraulic ram 191 is provided for pivotally moving the contracted column 161 about the hinge 189 between the collapsed and upright conditions.

The support head 153 comprises an inner ring structure 193 adapted for displacement along the column 161 while being fixed against rotation with respect thereto, and an outer hub structure 195 rotatably supported on the ring structure 193, as was the case with earlier embodiments.

As is also the case with earlier embodiments, the ring structure 193 is mounted on the column 161 for guided rolling movement therealong. In the present embodiment, however, there is a need for the inner ring structure 193 to accommodate the different lateral dimensions that exist along the column 161 as a result of the telescopic construction of the column, as well as the resultant steps 185, 187. For this purpose, the ring structure 193 is provided with four roller assemblies 200, one corresponding to each of the four longitudinal outer sides 162 of the column 161, with each roller assembly 200 adapted for rolling movement along one of the respective column sides.

The roller assemblies 200 are each mounted on a frame 201 forming part of the ring structure 193.

Each roller assembly 200 comprises two sets of rollers 210 mounted on the frame 201 spaced one with respect to the other in the longitudinal direction of the column 161, thereby providing two groups 205, 207.

Each roller set 210 comprises three rollers positioned for rolling engagement against a respective outer side 162 of the column 161. More particularly, each roller set 210 comprises a first roller 211, a second roller 212 and a third roller 213. The first roller 211 is provided for rolling engagement along the respective outer face 184 of the first column section 181, the second roller 212 is provided for rolling engagement along the respective outer face 184 of the second column section 182, and the third roller 213 is provided for rolling engagement along the respective outer column face 184 of the third column section 183.

It is necessary for each roller set 210 to accommodate the different lateral dimensions of the three column sections 181, 182 and 183. For this purpose, the second roller 212 in each roller set 210 is retractable from an operating condition in which it can rollingly engage the second column section 182 to guide movement of the ring structure 193 therealong. The second roller 212 is retractable into a retracted condition which accommodates the first column section 181. In the retracted condition, the second roller 212 rolls along the first column section 181, and in doing so interacts with that column section to provide some guidance. The third roller 213 is also retractable from an operating condition in which it can rollingly engage the third column section 183 to guide movement of the ring structure 193 therealong. The third roller 213 has two retracted conditions, being an intermediate retracted condition accommodating the second column section 182 and a fully retracted condition accommodating the first column section 181. In each of the intermediate retracted condition, the third roller 213 rolls along the second column section 182 in a floating fashion without the interaction necessarily providing any effective guidance, However, in the fully retracted condition the third roller 213 can interact with the first column section 181 to provide some guidance.

The second and third rollers 212, 213 are each biased towards its respective operating condition, and also is moveable away from that condition towards the relevant retracted condition upon contact with the step 185, 187 at the junction between adjacent column sections during descent of the support head 153 along the column 161.

Each first roller 211 is supported on a rigid arm 221, and each of the second and third rollers 212, 213 are supported on a swing arm. Specifically, each second roller 212 is supported on swing arm 222 and each third roller 213 is supported on swing arm 223. The swing arms 222 and 223 are pivotally supported on the frame 201 for pivotal movement between the operating and retracted conditions.

The swing arms 222, 223 are oriented so that the rollers supported thereon are biased into their operating conditions under the influence of gravity.

A stop 225 is associated with each swing arm 222, 223 to limit the extent of retraction of the swing arm. With this arrangement, the stop 225 associated with swing arm 222 determines the retracted condition thereof, and the stop 225 associated with the third swing arm 223 determines the fully retracted condition thereof.

The manner of operation of the roller assemblies is best seen with reference to FIGS. 24 to 28 of the drawings, where two opposed roller assemblies 200 are shown in engagement with the column 161. In the drawings, only two roller assemblies 200 are shown, being the roller assemblies in engagement with two opposed outer sides 162*a* and 162*b* of the column. It will be appreciated that there are a further two roller assemblies which are not shown in engagement with the other two opposed faces.

Figure 24:
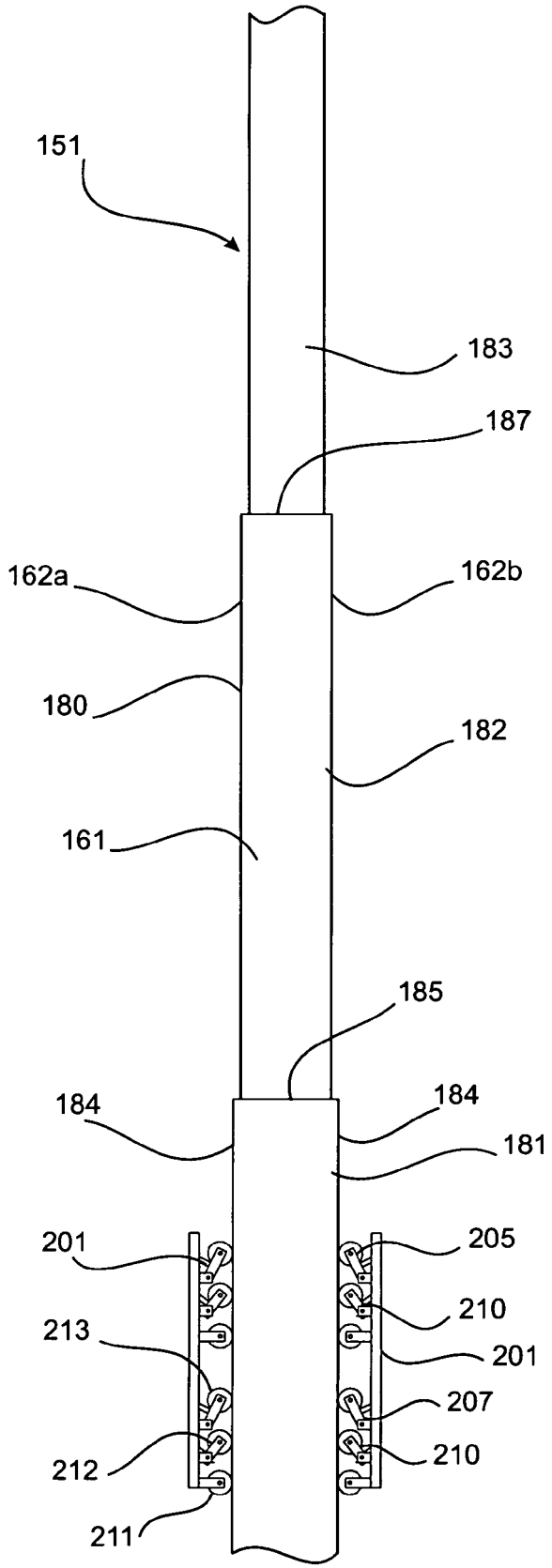
FIG. 24 is a schematic elevational view illustrating two roller assemblies forming part of the support head undergoing rolling movement along a lower section of the tower.

As is illustrated in FIG. 24, each of the rollers is in contact with the respective outer side 162 of the column 161. The first rollers 211 are in contact with the outer side 162 for guiding movement therealong by virtue of their position as determined by the rigid arms 221. The second rollers 212 are in rolling contact with the outer side 162 for guiding movement therealong by virtue of being in their retracted conditions as determined by their respective stops 225. Similarly, the third rollers 213 are in rolling contact with the outer side 162 for guiding movement therealong also by virtue of their fully retracted conditions as determined by their respective stops 225.

Figure 25:
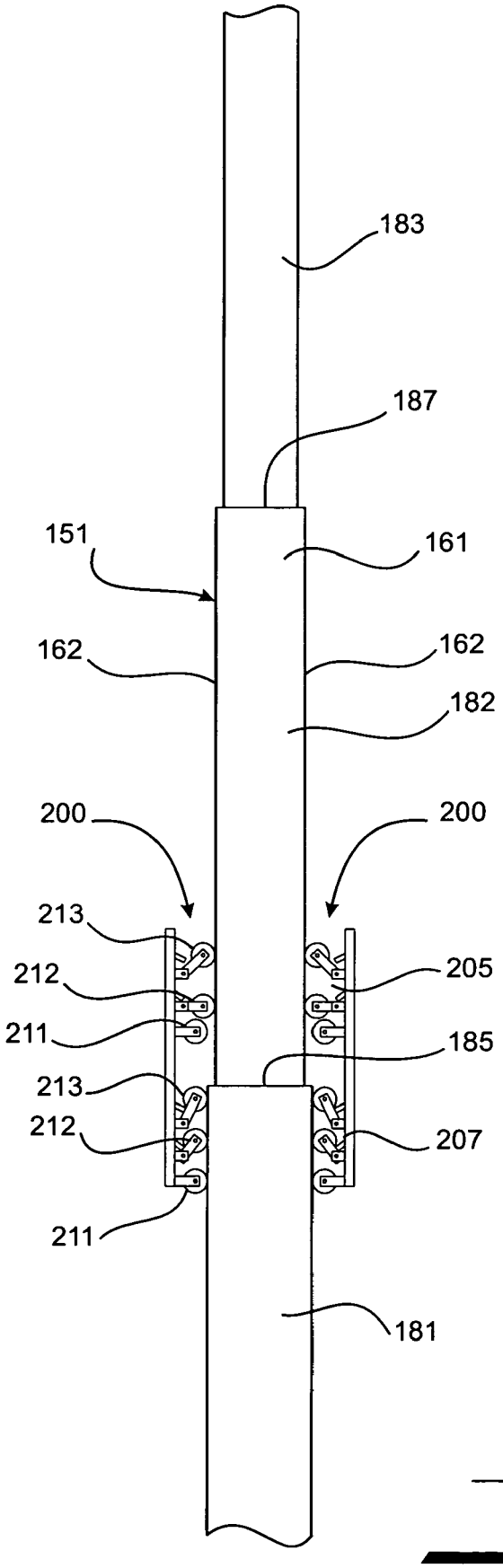
FIG. 25 is a view similar to FIG. 24, with the exception that the roller assemblies are shown moving over the transition between the lower section of the tower and an intermediate section thereof.

As the roller assemblies 200 move across the step 185 between the first and second column sections 181, 182, the second rollers 212 move under the influence of gravity into their operating conditions, and the third roller assemblies 213 move into their intermediate retracted conditions. At this stage, guiding support is provided by the trailing group 207 of rollers being in engagement with the first column section 181, and the second rollers 212 within the leading group 205 being in guiding engagement with the second column section 182, as shown in FIG. 25. While the third rollers 213 within the leading group 205 are in contact with the second column section 182, it is only a floating engagement by virtue of the influence of gravity; they do not provide any significant guiding support.

Figure 26:
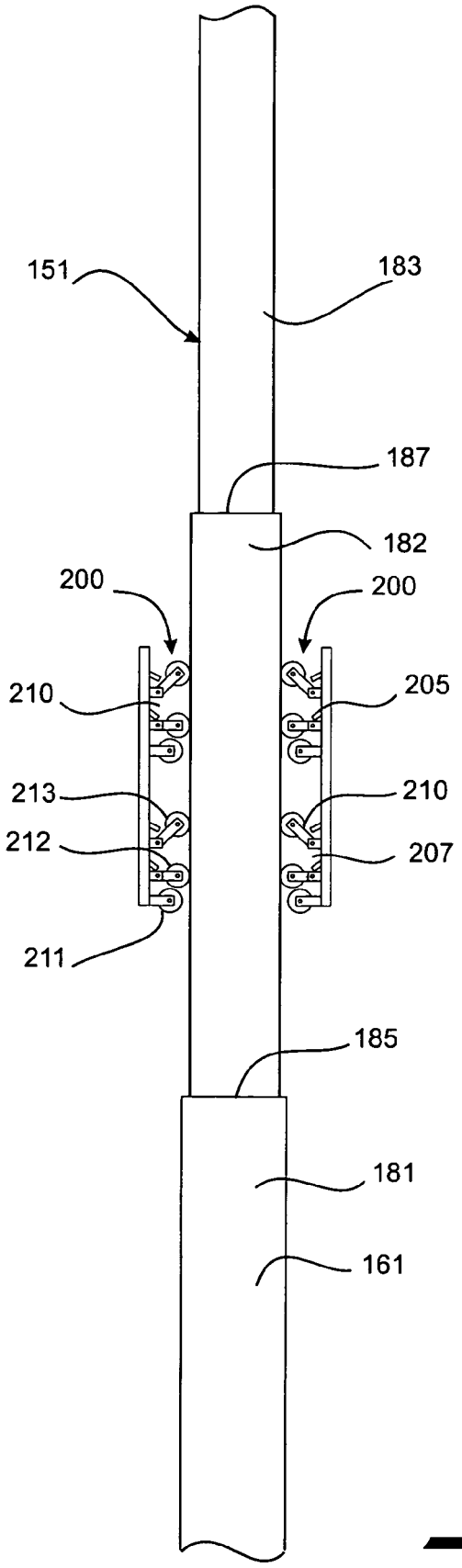
FIG. 26 is also a view similar to FIG. 24, with the exception that the roller assemblies are shown moving along the intermediate section of the tower.

Continued upward movement results in both rollers groups 205, 207 within the roller assemblies 200 being in contact with the second column section 182, as shown in FIG. 26. At this stage, guiding support is provided by the second rollers 212. The first rollers 211 are entirely clear of the second column section 182, and the third rollers 213 are merely in floating engagement with the columns section.

Figure 27:
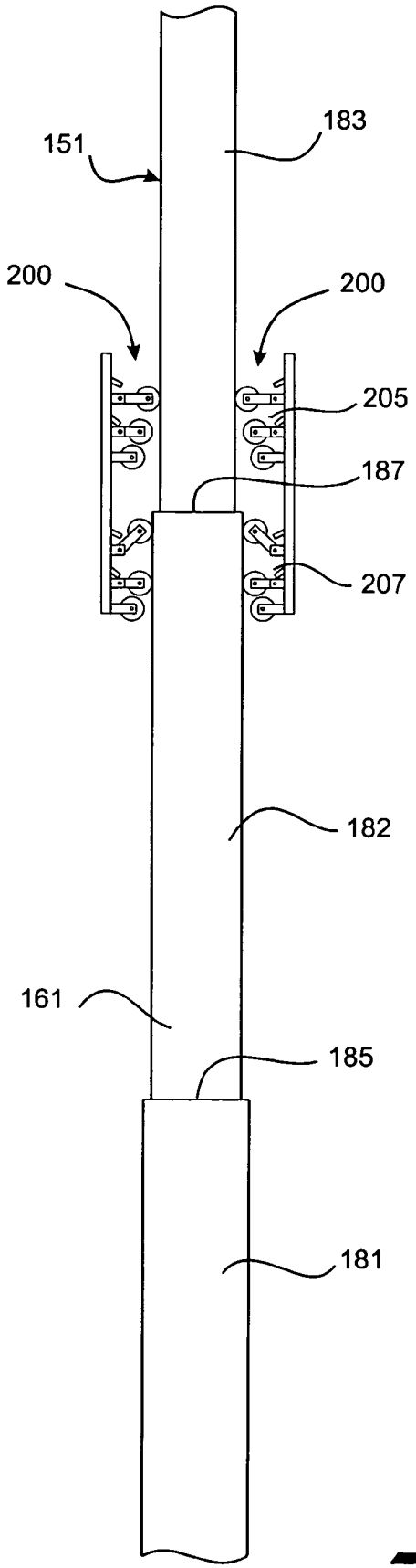
FIG. 27 is also a view similar to FIG. 24, with the exception that the roller assemblies are shown moving across the transition between the intermediate section of the tower and an upper section thereof.

As the roller assemblies 200 continue their upward movement they encounter the second step 187, as shown in FIG. 27 of the drawings. At this stage, the third rollers 213 in the leading group 205 have moved into their operating conditions for rolling engagement with the third column section 183, with the result that guiding movement is provided by those rollers in the leading group 205 as well as the second rollers 212 in the trailing group 207.

Figure 28:
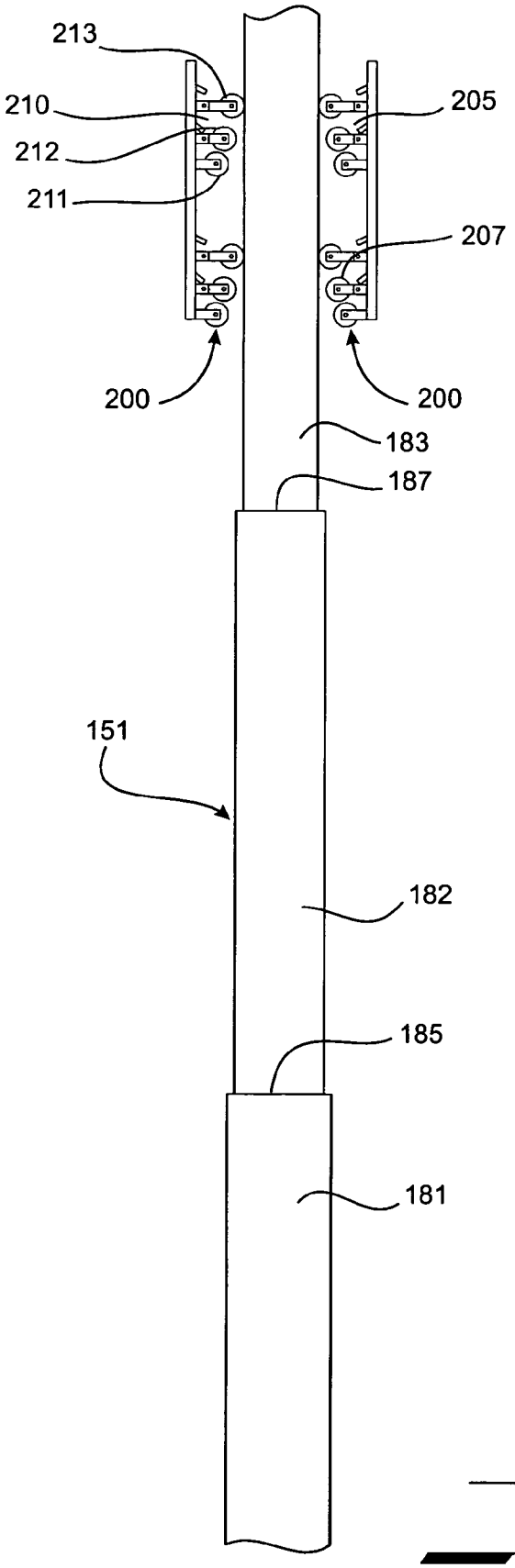
FIG. 28 is a still further view similar to FIG. 24, with the exception that the roller assemblies are shown moving along the upper section of the tower.
Figure 29:
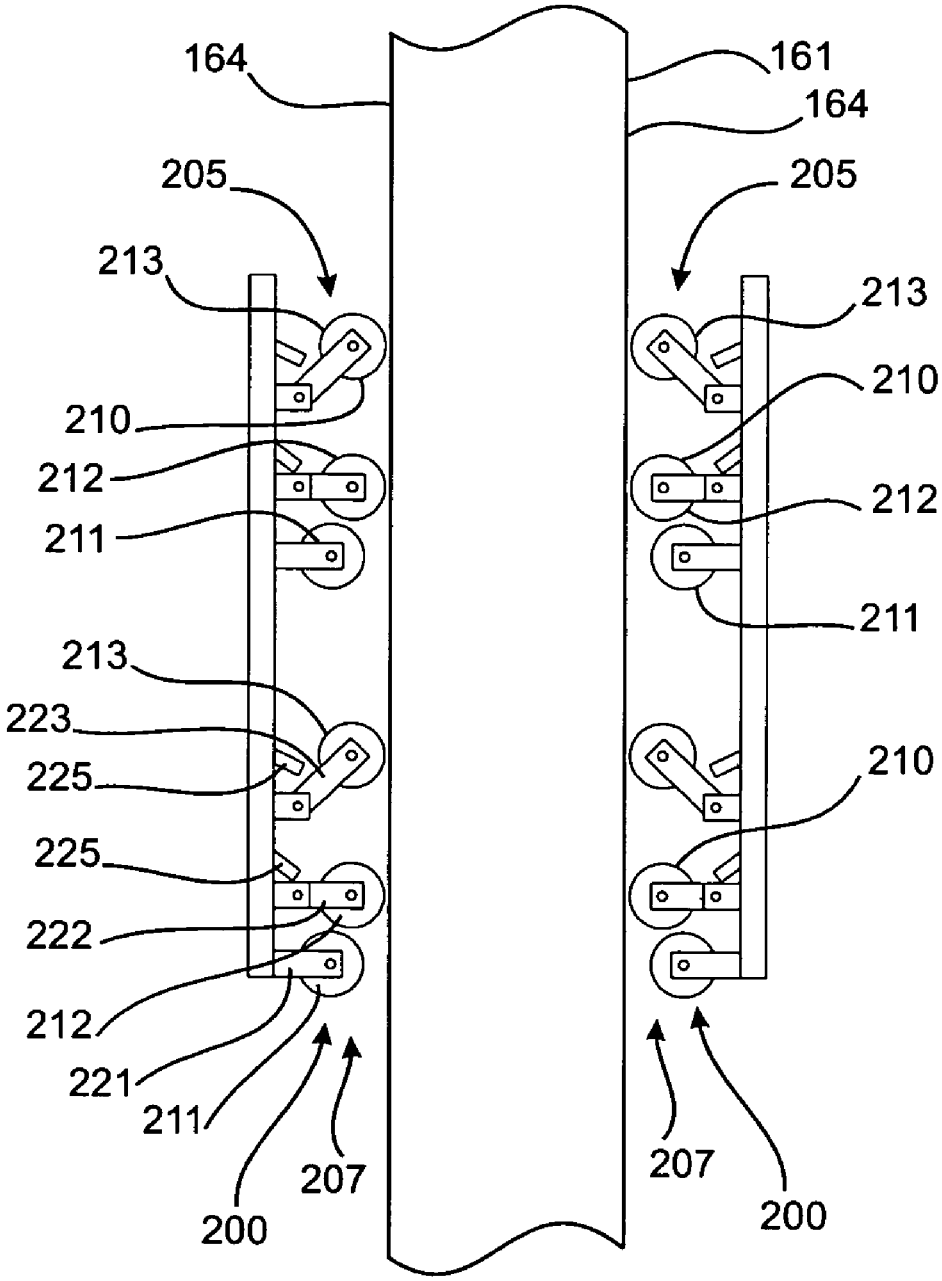
FIG. 29 is a fragmentary view illustrating the roller assemblies on a larger scale.

Further continued upward movement of the roller assemblies 200 results in all of the third rollers 213 being in rolling engagement with the third column section 183 for guiding movement therealong, as shown in FIG. 28.

A similar sequence operates upon reverse movement of the roller assemblies 200 upon descent of the support head 150. As the roller assemblies 200 encounter the step 187 during the descent, the second rollers 212 move into their operating conditions for engagement with the second column section 182 and the third rollers 213 are deflected into their intermediate retracted condition by contact with the step. Similarly, upon encountering the step 185, the first rollers 211 move into engagement with the first column section 181, and the second rollers 212 are deflected into their retracted conditions for rolling engagement with the first column section 181. Similarly, the third rollers 213 are deflected from their intermediate retracted condition into their fully retracted condition, also for rolling engagement with the first column section 181.

A first drive means (not shown) is provided for rotating the hub structure 195 with respect to the ring structure 193, thereby rotating the hub structure with respect to the column 161. The drive means is of similar construction, and also operates in a similar way, to first drive means 51 in earlier embodiment and so will not be described further.

A second drive means 231 is provided for displacing the support head 153, and thus the hub structure 195 forming part thereof, along the column 161. The second drive means 231 comprises a cable and pulley system 233 from which the support head 153 is suspended, together with a counterweight 235 and a winch mechanism 237. The winch mechanism 237 is mounted on the trailer 165.

The cable and pulley system 233 comprises a plurality of cables 239 (there being four such cables in this embodiment one corresponding to each side of the column). One end of each cable 239 is attached to the corresponding frame 201 of the ring structure 193 of the support head 153, and the other end of each cable is connected to the counter-weight 235. Each cable 239 passes over a respective pulley system 241 mounted on the column 161 at a location above the uppermost extent of displacement of the support head 153. From the connection to the support head 153, each cable 239 passes upwardly to be routed around its respective pulley system 241 and then extends downwardly to the counter-weight 235. The counter-weight 235 is connected to the winch mechanism 237 by way of a pair winch cables 245. The winch cables 239 are provided as a pair for safety purposes. The winch mechanism 237 incorporates a winch drum 247 about which the winch cables 245 can be wound and unwound.

The counter-weight 235 is selected such that the support head 153 can travel downwardly under the influence of gravity, with its weight being partly compensated by the counter-weight 235. The rate of decent of the support means 153 on the column 161 is controlled by the rate at which the winch cables 245 are unwound from the winch mechanism 237. The winch mechanism 67 incorporates a disc brake (not shown) operation of which can regulate the rate at which the winch cable 245 are unwound.

The counter-weight 235 is accommodated within the open interior 251 in the column 161. This provides for compactness of construction.

Additionally, a safety brake 249 is associated with each cable 239 in the cable and pulley system 233.

Operation of the winch mechanism 237 to wind the winch cables 245 about the winch drum 247 pulls the counter-weight 235 downwardly, thereby pulling the support head 153 upwardly through the cable and pulley system 233.

The outer hub structure 195 comprises an inner hub portion 261 rotatably supported on the inner ring structure 93, and a plurality of outriggers 263 extending outwardly from the inner hub portion 261.

Figure 22:
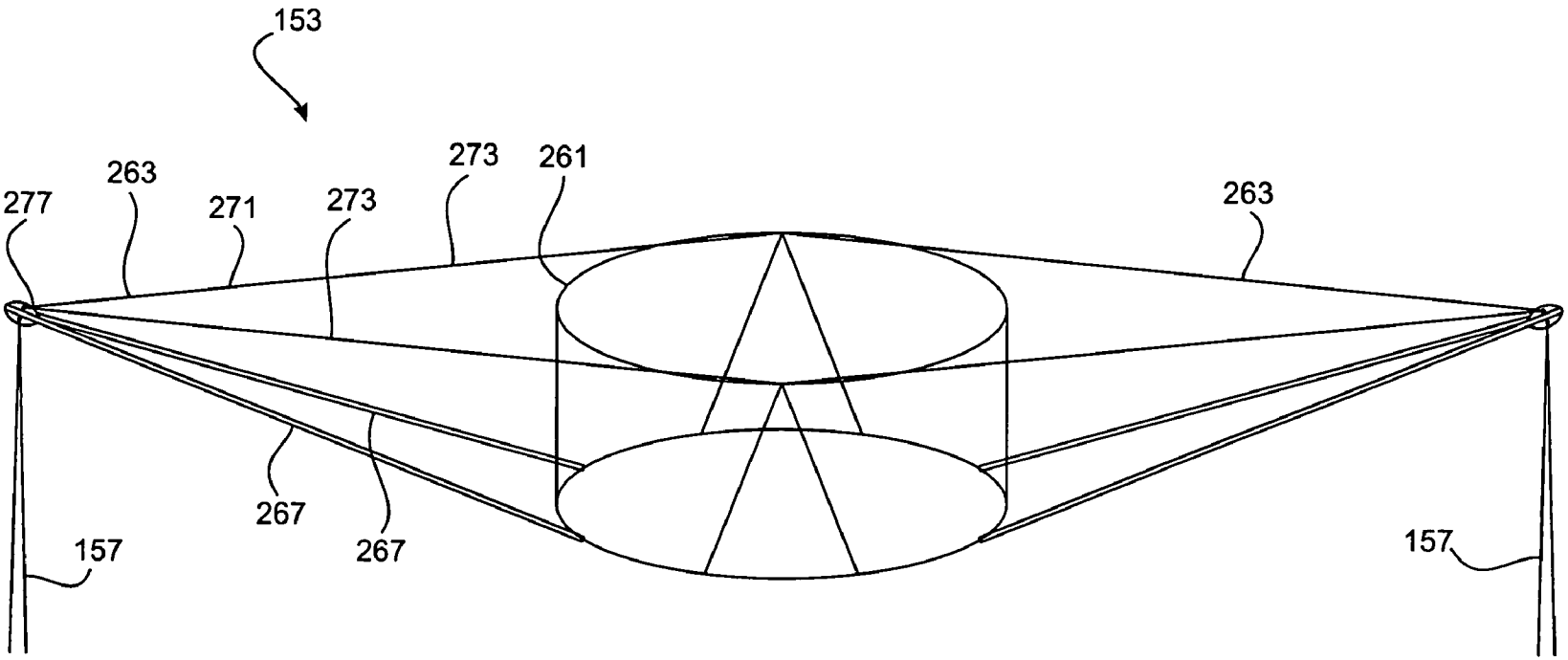
FIG. 22 is a schematic perspective view of the support head but only showing two opposed outriggers.
Figure 23:
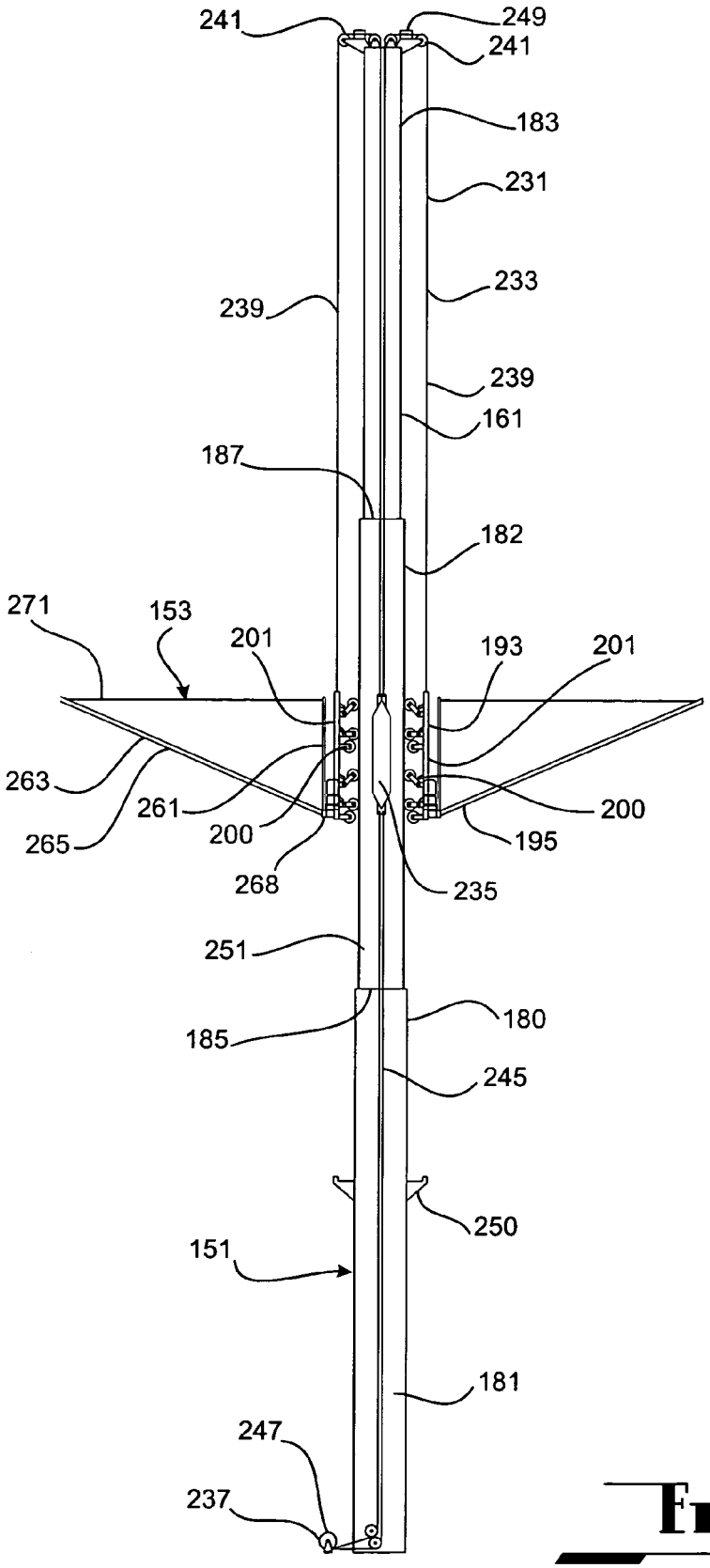
FIG. 23 is a schematic side view illustrating the support head mounted on the tower for rolling movement therealong.

Each outrigger 263 comprises a rigid outrigger arm 265 configured as a pair of rigid elements 267, as shown in FIG. 22. The outrigger arm 265 is pivotally connected at its inner end by hinge 268 to the inner hub portion 261.

Each outrigger 263 further comprises a flexible tensile element 271 configured as two cables 273 each attached at one end 275 to the inner hub portion 261 and attached at 277 to the outer end of the rigid outrigger arm 265.

Figure 15:
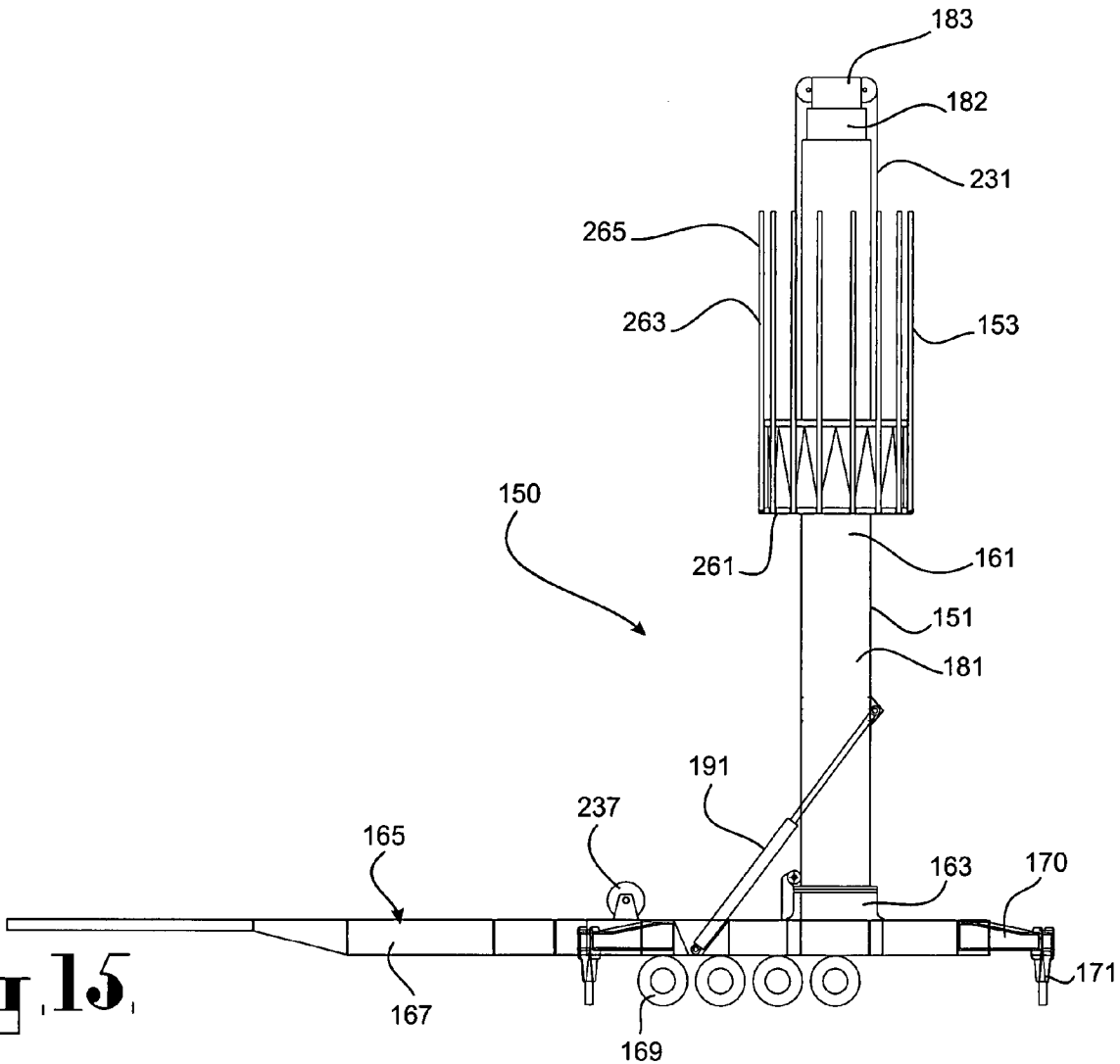
FIG. 15 is a schematic side elevational view of the amusement ride of FIG. 13, shown at one stage of the erection process.

With this arrangement, the outriggers 263 are foldable between an operating condition extending outwardly from the inner hub portions 261 for supporting riders (as shown in FIG. 13) and a collapsed condition (as shown in FIGS. 14 and 15).

Each outrigger 263 is moveable from the operating condition to the collapsed condition by pivotal movement of the rigid outrigger arms 265 about the hinges 268. In the collapsed condition, the rigid outrigger arms 265 are folded upwardly to lie alongside the column 161. The flexible nature of the cables 273 facilitate folding movement of the outrigger arms 265. The outriggers 263 are returned to the operating condition by folding the rigid outrigger arms 265 outwardly about the hinge axis 268 until the cables 273 are under tension, thereby supporting the rigid outrigger arms in the extended condition.

A control mechanism (not shown) is provided for moving the outrigger portion 263 between the folded and extended conditions.

Folding of the outriggers 263 provides the support head 153 with the feature of collapsibility.

A cradle 250 is provided for accommodating the support head 153 in its lowermost position on the column 161. The support head 153 is rested on the cradle 250 before the support head 153 is collapsed.

Once erected, the amusement ride 150 according to this embodiment operates in a generally similar way to the amusement ride 10 of the first embodiment. However, the amusement ride 150 is mobile and that aspect of the ride will now be described.

Figure 16:
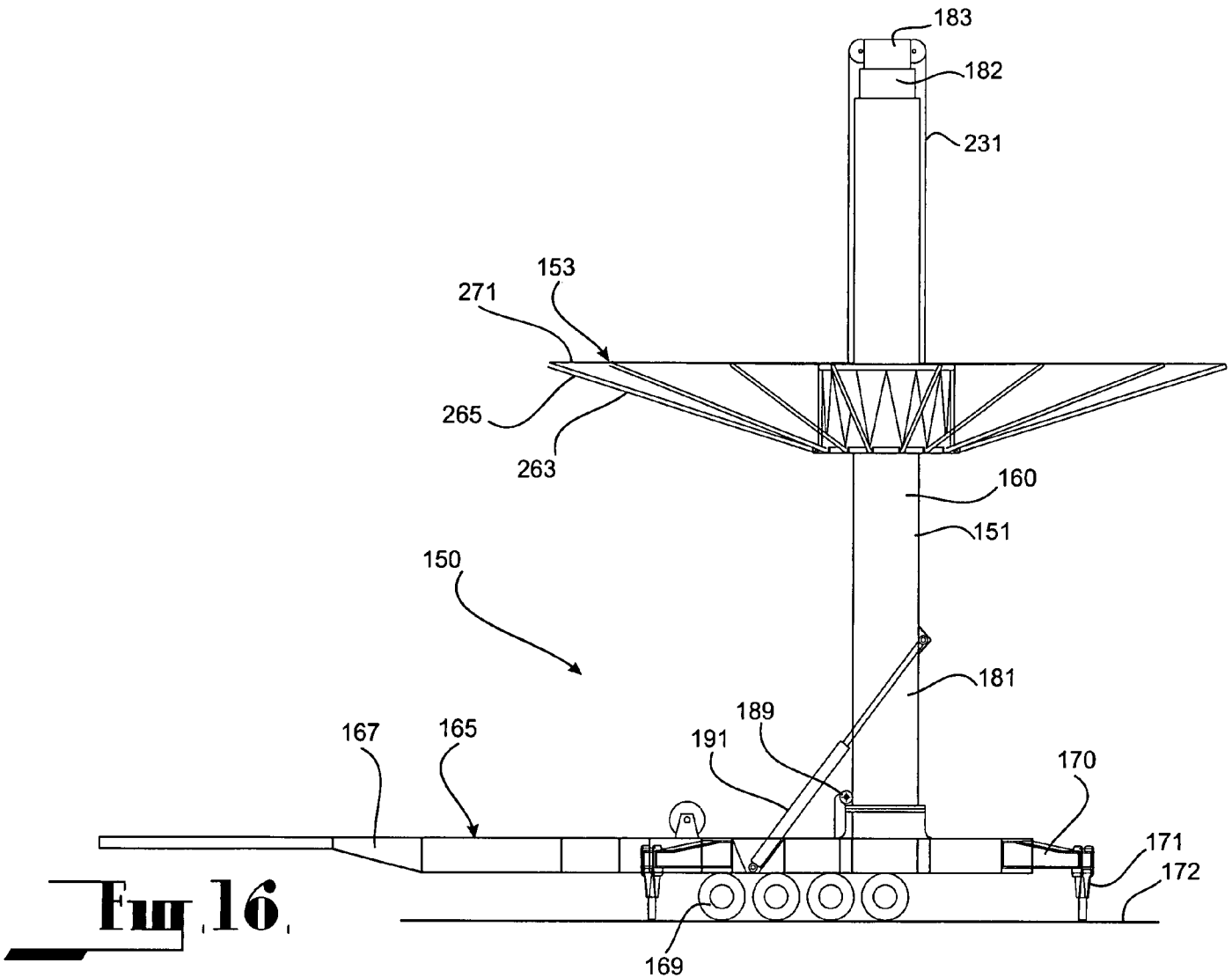
FIG. 16 is a schematic side elevational view of the amusement ride of FIG. 13, shown at a further stage of the erection process.
Figure 17:
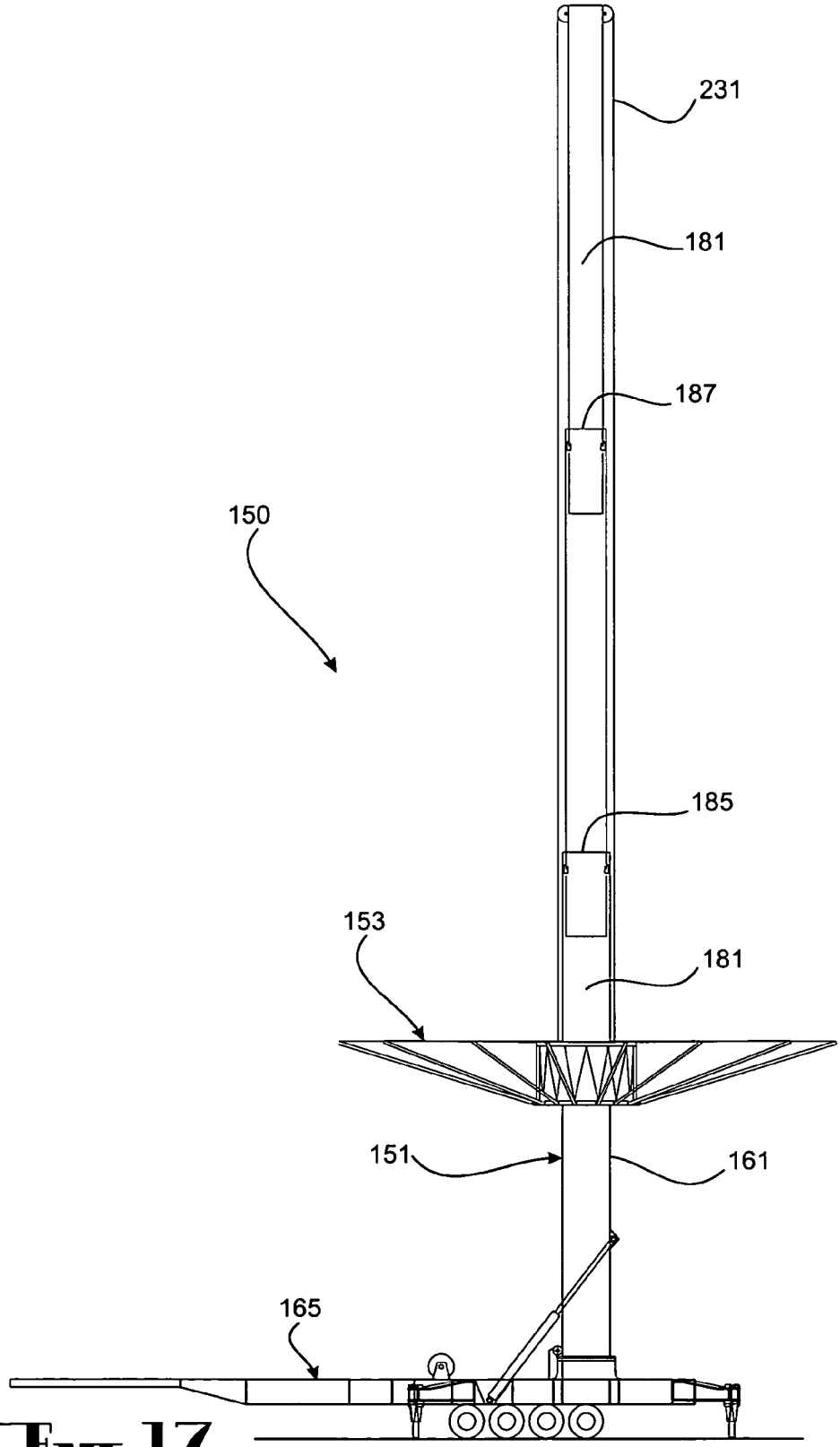
FIG. 17 is a schematic side elevation view of the amusement ride of FIG. 13, shown at a still further stage of the erection process.
Figure 18:
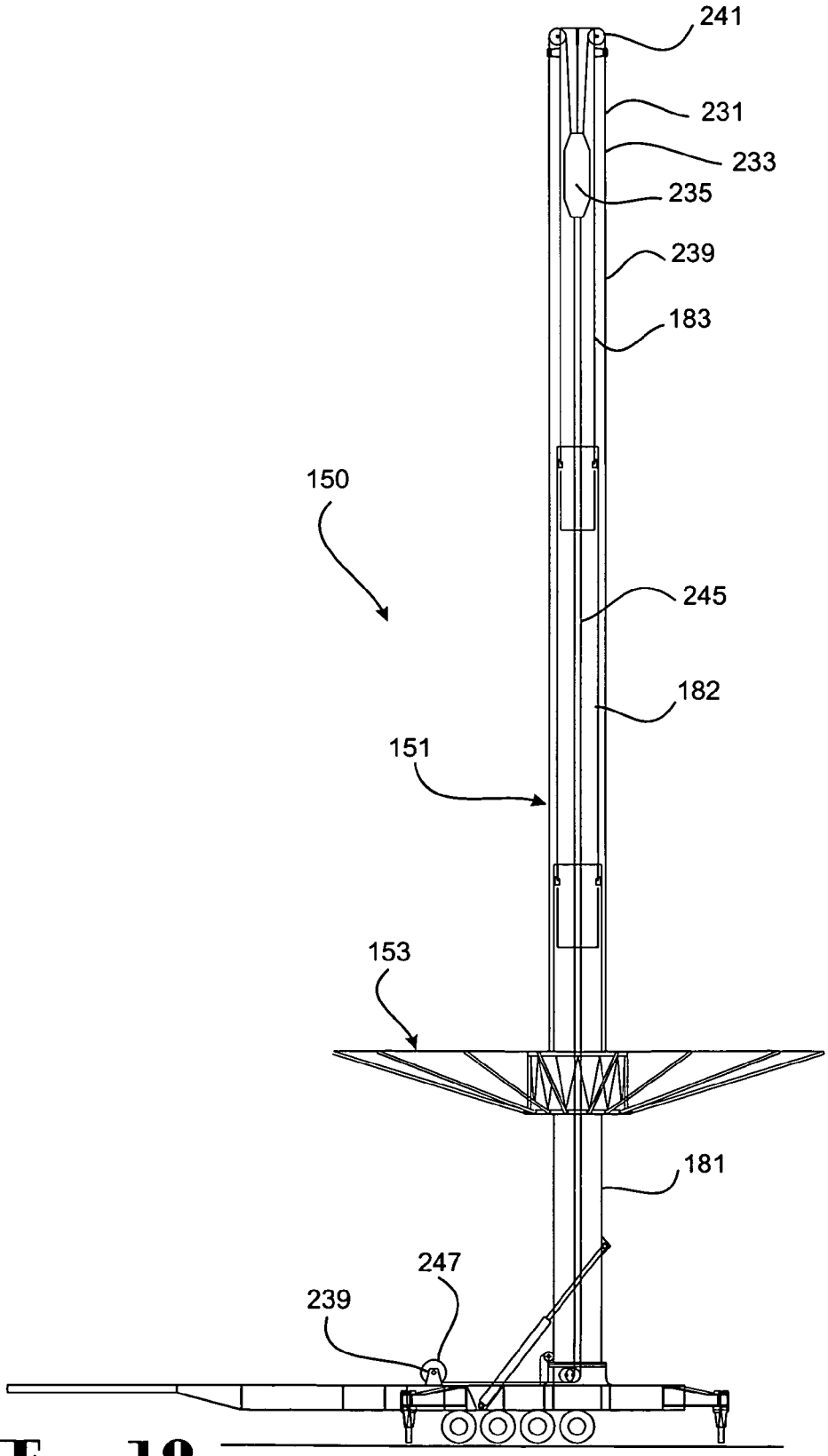
FIG. 18 is a view similar to FIG. 17, with the exception that it illustrates some componentry not previously visible.

As explained previously, the amusement ride 150 has a collapsed condition for transport, as illustrated in FIG. 14. In the collapsed condition, the amusement ride 150 is accommodated on the trailer 165 which can be towed to a site at which the amusement ride is to be erected. Upon arrival at the site, the stabilizer system 170 is deployed, involving extension of the outrigger legs 171 outwardly for engagement with the ground, as illustrated in FIG. 20. Once the trailer 165 has been stabilized, the column 161 is pivoted from the collapsed condition into the upright condition by operation of the hydraulic ram 191. At this stage, the amusement ride 150 is in the condition illustrated in FIG. 15. It will be noted that the column 161 is still in its contracted condition and the support head 153 is also in its collapsed condition. The support head 153 is then moved from the collapsed condition to the operating condition, involving pivotal movement of the outriggers 263 outwardly into the extended condition, as shown in FIG. 16. The column 161 is then moved from the contracted condition into the extended condition, as shown in FIG. 17. Other procedures involved in assembly of the amusement ride 150 for use can then be completed.

As alluded to previously, the ride 150 operates in a similar fashion to the ride 10 according to the first embodiment, and so will not require further description, apart from noting that the roller assemblies 200 operate in the manner described in relation to FIGS. 24 to 28 in order to accommodate the various lateral dimensions of the column 161.

When the amusement ride 150 is to be removed from site, it is disassembled in a procedure which is essentially a reverse of the assembly procedure, returning the ride 150 to the collapsed condition, as shown in FIG. 14, where it is accommodate on the trailer 165 for transport to another location.

From the foregoing, it is evident that the present invention provides an amusement ride involving one or more riders being conveyed through the air but with the possibility of sufficient variation to provide an exciting ride conducive to riders returning for further rides.

The amusement ride according to the invention can be constructed on a large scale such that the riders are elevated to a height that in itself provides excitement. The amusement ride is of a design which is conducive to construction on such a large scale. This is achievable even in the mobile amusement ride which is collapsible onto a trailer for transport, owing to the telescopic nature of the column and the ability of the support head to move along the telescopic column in a manner accommodating variations in lateral dimensions of the column.

The ride also incorporates a simple yet highly effective arrangement for driving the support head both rotationally for moving the riders around through the air, and also linearly for varying the elevation of the riders during the ride as well as raising and lowering the riders with respect to the ground or a station at which the riders embark upon, and disembark from, the ride.

Modifications and improvements may be made without departing from the spirit of the invention.

Throughout the specification, unless the context requires otherwise, the word "comprise" or variations such as "comprises" or "comprising", will be understood to imply the inclusion of a stated integer or group of integers but not the exclusion of any other integer or group of integers.

The invention claimed is:

1. An aerial amusement ride comprising:

(a) a column, extending from a base portion to a rider carrier support portion, said column comprising:

(i) a plurality of elongated members;

(ii) a plurality of struts, said elongated members being interconnected by said plurality of struts, said elongated members and said struts forming an open framework structure with open spaces defined by said elongated members and said struts, said elongated members defining at least one support surface, said support surface extending from points proximate said rider carrier support portion of said column to points proximate the base portion of said column, (b) a hub displaceably mounted on said column, said hub riding on said at least one support surface, whereby said hub may be displaced along said column, (c) a pulley mounted on said column above or proximate said rider carrier support portion, (d) a first drive motor, (e) a cable having a first point on said cable and a second point on said cable, said cable extending around said pulley, said cable being coupled at said first point on said cable to said hub and at said second point on said cable to said first drive motor, (f) a support structure mounted for rotation on said hub, (g) a plurality of rider carriers configured to support riders, and (h) a plurality of links secured to said support structure at one link end at a radial distance from the column and to said rider carriers at an other link end, said links allowing, upon rotation of said support structure and resultant movement of said rider carriers around the axis of said column, the rider carriers to move radially outwards from the column as the speed of rotation of said support structure increases.

2. An amusement ride according to claim 1, wherein said column comprises a longitudinal series of column sections.

3. An amusement ride according to claim 2, wherein said first drive motor is operable for selectively causing said hub and support structure to undergo displacement with respect to said column.

4. An amusement ride according to claim 2, wherein said column sections are detachably connected to one another.

5. An amusement ride according to claim 1, wherein said open framework construction of said column defines an elongated open space within said column.

6. An amusement ride according claim 1, wherein said links comprise flexible suspension links.

7. An amusement ride according to claim 6, wherein each said flexible suspension link comprises at least one flexible line.

8. An amusement ride according to claim 1, wherein each rider carrier is connected to said support structure for swiveling movement with respect thereto.

9. An amusement ride according to claim 8, wherein said swiveling movement is provided by a swivel connection between said link and said support structure.

10. An amusement ride according to claim 9, wherein said swiveling movement comprises rotation about an axis corresponding to a longitudinal axis of said link.

11. An amusement ride according to claim 8, wherein each rider carrier is adapted to rotate about a rotational axis transverse to a longitudinal axis of said link.

12. An amusement ride according to claim 11, wherein said rider carrier is provided with a control device for imparting rotational motion about said rotational axis during movement of the rider carrier through the air.

13. An amusement ride according to claim 12, further comprising a rider-operated control device for operating said control device during the ride for providing variation to the ride, said rider-operated control device being positioned for operation by a rider.

14. An amusement ride according to claim 1, further comprising a base, said column extending upwardly from said base.

15. An amusement ride according to claim 14, wherein said base is adapted to be releasably anchored to the ground.

16. An amusement ride according to claim 1, wherein said column extends to a height of at least 30 meters.

17. An amusement ride according to claim 16, wherein said column has a height of about 60 meters.

18. An amusement ride according to claim 1, wherein said support structure comprises a plurality of outriggers, each carrying a respective one of said links that carries a respective one of said rider carriers.

19. An amusement ride according to claim 1, further comprising a second drive motor for rotating said hub with respect to said column.

20. An amusement ride according to claim 19, wherein said second drive motor comprises a drive wheel and a drive wheel motor for rotating the drive wheel, the drive wheel being in driving engagement with said support structure, whereby rotation of the drive wheel causes rotation of said support structure with respect to said column.

21. An amusement ride according to claim 1, wherein said hub is mounted on said column for guided rolling movement along said column.

22. An amusement ride according to claim 1, wherein said hub is rotatably supported on a ring structure adapted for displacement along said column while being fixed against rotation with respect to said column; and wherein said ring structure has rollers in rolling engagement with tracks on the column that are defined by at least some of said elongate elements within the framework construction.

23. An amusement ride according to claim 22, further comprising a counter-weight that is arranged to travel along said column to counterbalance the weight of said hub and support structure.

24. An amusement ride according to claim 23, wherein said counter-weight is arranged to travel within said column.

25. An amusement ride according to claim 23, wherein movement of said counter-weight is guided by elements of said column.

26. An amusement ride according to claim 25, wherein movement of said counter-weight is guided by said elongated members of said column.

27. An amusement ride according to claim 1, wherein said cable and pulley are part of a cable and pulley system, said cable and pulley system comprising a plurality of cables and associated pulleys, each cable being connected at one end to said support structure, extending upwardly over its respective pulley and downwardly to be operable by a winch mechanism.

28. An amusement ride according to claim 27, further comprising a braking mechanism associated with said winch mechanism for retarding downward movement of said support structure with respect to said column, the brake mechanism comprising a disc brake provided on said winch mechanism.

29. An amusement ride according to claim 1, further comprising a counter-weight accommodated within an open space defined by said elongated members and struts within said column.

30. An amusement ride according to claim 27, wherein said winch mechanism is accommodated within an open space defined by said elongated members and struts within said column.

31. An amusement ride according to claim 1, further comprising a loading station adjacent the base of the column, at which riders may be loaded onto, and unloaded from, the ride.

32. An amusement ride according to claim 31, wherein said loading station comprises a platform which extends around the column.

33. An amusement ride according to claim 31, wherein said loading station comprises a platform and stairs for accessing the platform.

34. An amusement ride according to claim 1, wherein each of said elongated members presents a pair of adjacent faces to the outside of said column.

35. An amusement ride according to claim 1, wherein each of said elongated members is of faceted cross-section.

36. An aerial amusement ride comprising:

(a) a column, comprising a plurality of elongated members interconnected by a plurality of struts to form an open framework structure with open spaces defined by said elongated members and said struts, (b) opposing rotatably-mounted anti-rotation members, said elongated members having two substantially flat surfaces for receiving said opposing anti-rotation members, (c) a support structure mounted for rotation on said column and coupled to said anti-rotation members, (d) a plurality of rider carriers configured to support riders, and (e) a plurality of links secured to said support structure at one link end at a radial distance from the column and to said rider carriers at an other link end.

37. An aerial amusement ride comprising:

(a) a column having a rider carrier support portion, comprising a plurality of elongated members substantially parallel to each other and interconnected by a plurality of struts to form an open framework structure with open spaces defined by said elongated members and said struts, (b) a support structure, (c) a pulley mounted on said column above or proximate said rider carrier support portion, (d) a first drive motor, (e) a cable having a first point on said cable and a second point on said cable, said cable extending around said pulley, said cable being coupled at said first point on said cable to said support structure and at said second point on said cable to said first drive motor, (f) a plurality of rider carriers configured to support riders, (g) a plurality of links secured to said support structure at one link end and to said rider carriers at an other link end, and (h) a reciprocating member connected to said cable, said reciprocating member being positioned to ride in an elongated substantially vertical space contained within and defined by said plurality of elongated members and struts.

38. An aerial amusement ride as in claim 37 wherein said reciprocating member is a counterweight.

39. An aerial amusement ride as in claim 37 wherein said support structure comprises a fixed base and a rotating circumferential member mounted for rotation on said column, and said fixed base being further mounted to ride up and down said fixed base on a plurality of wheel pairs, said wheels in said wheel pairs being oriented with axes of rotation extending at an angle to each other, such that rotation of said fixed base in one direction is prevented by one wheel of said wheel pair, while rotation in the opposite direction is prevented by the other wheel of said wheel pair.

40. An aerial amusement ride as in claim 37, wherein said reciprocating member is directly secured to said cable.

41. An aerial amusement ride comprising:

(a) a column having a top portion and a bottom portion, comprising a plurality of elongated members interconnected by a plurality of struts to form an open framework structure with open spaces defined by said the elongated members and said struts, said elongated members forming a plurality of support rails extending from points proximate said top portion to points proximate said bottom portion, (b) a support structure, comprising a fixed base and a rotating circumferential member, said fixed base being mounted on said column, and said rotating circumferential member being mounted on said fixed base for rotation with respect to said fixed base, and said fixed base being further mounted to ride up and down said column on a plurality of wheel pairs, each wheel of said wheel pair bearing against the support rail formed by said elongated members, said wheels in said wheel pairs being oriented with axes of rotation extending at an angle to each other, such that rotation of said fixed base in one direction is prevented by one wheel of said wheel pair, while rotation in the opposite direction is prevented by the other wheel of said wheel pair, (c) a plurality of rider carriers configured to support riders, and (d) a plurality of links secured to said support structure at one link end at a radial distance from the center of the column and to said rider carriers at an other link end.

42. A ride as in claim 41 wherein said links allow, upon movement of said rider carriers, said rider carriers to move with a vector parallel to the horizon.

43. An aerial amusement ride comprising:

(a) a column having a top portion and a base portion defining an elongated support structure extending from a point proximate said top portion to a point proximate said base portion, (b) a support structure, comprising a fixed base and a rotating circumferential member mounted for rotation on said fixed base and said support structure being further mounted to ride up and down said column on a plurality of wheel pairs, said wheels in said wheel pairs being oriented with axes of rotation extending at an angle to each other, such that rotation of said fixed base in one direction is prevented by one wheel of said wheel pair, while rotation in the opposite direction is prevented by the other wheel of said wheel pair, said wheel pairs bearing against said elongated support structure, (c) a plurality of rider carriers configured to support riders, (d) a plurality of links, secured to said support structure at one link end at a radial distance from the center of the column and to said rider carriers at an other link end, said links allowing, upon movement of said rider carriers around the axis of said column, the rider carriers to move radially outwards from the column as the speed of rotation of said support structure increases, (e) at least one cable connected to said support structure a first point on said cable, and (f) a reciprocating member connected to a second point on said at least one cable, said reciprocating member being positioned to ride in an elongated substantially vertical space contained within and defined by said column.

44. An aerial amusement ride as in claim 43, wherein said column comprises a plurality of elongated members interconnected by a plurality of struts to form an open framework structure with open spaces defined by said the elongated members and said struts.

45. An aerial amusement ride comprising:

(a) a column, extending from a base portion to a rider carrier support portion, said column comprising:

(i) a plurality of elongated members, (ii) a plurality of struts, said elongated members being interconnected by a said plurality of struts, said elongated members and said struts forming an open framework structure with open spaces defined by said elongated members and said struts, said elongated members defining at least one support surface, said support surface extending from points proximate said rider carrier support portion of said column to points proximate the base portion of said column, (b) a hub displaceably mounted on said column, said hub riding on said at least one support surface, whereby said hub may be displaced along said column, (c) a pulley mounted on said column above or proximate said rider carrier support portion, (d) a first drive motor, (e) a cable having a first point on said cable and a second point on said cable, said cable extending around said pulley, said cable being coupled at said first point on said cable to said hub and at said second point on said cable to said first drive motor, (f) a support structure mounted for rotation on said hub, (g) a plurality of rider carriers configured to support riders, and (h) a plurality of links secured to said support structure at one link end at a radial distance from the center of the column and to said rider carriers at an other link end, said links allowing, upon rotation of said support structure and resultant movement of said rider carriers around the axis of said column, the rider carriers to move radially outwards from the column as the speed of rotation of said support structure increases, wherein said open framework construction of said column defines an elongated open space within said column, wherein each rider carrier that is connected to said support structure for swiveling movement with respect thereto, and further comprising a base, said column extending upwardly from said base.

46. An amusement ride according to claim 45, wherein said hub is mounted on said column for guided rolling movement along said column, and said hub has rollers in rolling engagement with said support surface.

* * * * *